US008864960B2

(12) United States Patent
Yao et al.

(10) Patent No.: US 8,864,960 B2
(45) Date of Patent: Oct. 21, 2014

(54) FLUORINE GAS GENERATING APPARATUS

(75) Inventors: Akifumi Yao, Ube (JP); Tatsuo Miyazaki, Ube (JP); Yosuke Nakamura, Ube (JP); Keita Nakahara, Ube (JP); Nobuyuki Tokunaga, Ube (JP)

(73) Assignee: Central Glass Company, Limited, Ube-shi (JP)

( * ) Notice: Subject to any disclaimer, the term of this patent is extended or adjusted under 35 U.S.C. 154(b) by 219 days.

(21) Appl. No.: 13/513,812

(22) PCT Filed: Nov. 25, 2010

(86) PCT No.: PCT/JP2010/071015
§ 371 (c)(1),
(2), (4) Date: Jun. 4, 2012

(87) PCT Pub. No.: WO2011/068071
PCT Pub. Date: Jun. 9, 2011

(65) Prior Publication Data

US 2012/0241313 A1 Sep. 27, 2012

(30) Foreign Application Priority Data

Dec. 2, 2009 (JP) ..... 2009-274676

(51) Int. Cl.
*C25B 1/24* (2006.01)

(52) U.S. Cl.
CPC ..... *C25B 1/245* (2013.01)
USPC ..... 204/247; 205/411; 205/619

(58) Field of Classification Search
None
See application file for complete search history.

(56) References Cited

U.S. PATENT DOCUMENTS 5,290,413 A * 3/1994 Bauer et al. ..... 204/243.1
6,010,612 A 1/2000 Freire et al.

(Continued)

FOREIGN PATENT DOCUMENTS

JP 4-143288 A 5/1992
JP 2986885 B2 12/1999

(Continued)

OTHER PUBLICATIONS

Froning et al, Purification and compression of Fluorine, Industrial and Engineering Chemistry, vol. 39, No. 3, Mar. 1947, pp. 275-278.*

(Continued)

*Primary Examiner* — Harry D Wilkins, III
(74) *Attorney, Agent, or Firm* — Westerman, Hattori, Daniels & Adrian, LLP

(57) ABSTRACT

A fluorine gas generating apparatus generating a fluorine gas by electrolyzing hydrogen fluoride in molten salt, includes: an electrolytic cell including, above a liquid level of molten salt, a first gas chamber into which a product gas mainly containing the fluorine gas generated at an anode immersed in the molten salt and a second gas chamber separated from the first gas chamber into which a byproduct gas mainly containing a hydrogen gas generated at a cathode immersed in the molten salt; a hydrogen fluoride supply source retaining hydrogen fluoride to be replenished in the electrolytic cell; a refining device trapping a hydrogen fluoride gas evaporated from the molten salt in the electrolytic cell and mixed in the product gas generated from the anode to refine the fluorine gas; and a recovery facility conveying and recovering the hydrogen fluoride trapped in the refining device in the electrolytic cell or the hydrogen fluoride supply source.

10 Claims, 10 Drawing Sheets

(56) References Cited

U.S. PATENT DOCUMENTS

| | | | | |
|---|---|---|---|---|
| 2002/0074013 | A1 | 6/2002 | Shang et al. | |
| 2003/0047445 | A1 | 3/2003 | Tojo et al. | |
| 2004/0055874 | A1 | 3/2004 | Hiraiwa et al. | |
| 2005/0011766 | A1 * | 1/2005 | Tojo et al. | 205/81 |
| 2005/0252451 | A1 | 11/2005 | Beppu et al. | |
| 2009/0260981 | A1 | 10/2009 | Tanaka et al. | |

FOREIGN PATENT DOCUMENTS

| | | | |
|---|---|---|---|
| JP | 2001-516333 | A | 9/2001 |
| JP | 2002-339090 | A | 11/2002 |
| JP | 2004-039740 | A | 2/2004 |
| JP | 2004-043885 | A | 2/2004 |
| JP | 2004-107761 | A | 4/2004 |
| JP | 2005-264231 | A | 9/2005 |
| JP | 2009-024222 | A | 2/2009 |
| WO | WO 03/046244 | A1 * | 6/2003 |
| WO | 2009/014078 | A1 | 1/2009 |

OTHER PUBLICATIONS

International Search Report for PCT/JP2010/071015, of mailing date Mar. 1, 2011.

Taiwanese Office Action dated May 15, 2013, issued in corresponding Application No. 099141778.

Chinese Office Action dated May 6, 2014, issued in corresponding Chinese Patent Application No. 201080054728.2 (6 pages).

* cited by examiner

FLUORINE GAS GENERATING APPARATUS

TECHNICAL FIELD

The present invention relates to a fluorine gas generating apparatus.

BACKGROUND ART

As a prior-art fluorine gas generating apparatus, an apparatus which generates fluorine gas by electrolysis using an electrolytic cell is known.

JP2004-43885A discloses a fluorine gas generating apparatus provided with an electrolytic cell for electrolyzing hydrogen fluoride in molten salt containing hydrogen fluoride, generating a product gas mainly containing a fluorine gas in a first gas phase section on an anode side, and generating a byproduct gas mainly containing a hydrogen gas in a second gas phase section on a cathode side.

In this type of fluorine gas generating apparatus, a hydrogen fluoride gas evaporated from the molten salt is mixed in the fluorine gas generated from the anode of the electrolytic cell. Thus, it is necessary to refine the fluorine gas by separating hydrogen fluoride from the gas generated from the anode.

JP2004-39740A discloses a device which separates a fluorine gas component from a component other than the fluorine gas component through cooling using liquid nitrogen or the like by using a difference in boiling points of the both.

Moreover, JP 2004-107761A discloses an apparatus which removes hydrogen fluoride from a fluorine gas generated from an anode by using a hydrogen fluoride adsorption tower filled with a filler of sodium fluoride (NaF) or the like.

SUMMARY OF INVENTION

In the apparatuses for refining a fluorine gas as described in JP2004-39740A and JP2004-107761A, the components other than the fluorine gas removed as a result of refining have not been used but discharged.

The present invention has been made in view of the above problems and has an object to provide a fluorine gas generating apparatus which can effectively use a component other than a fluorine gas trapped in a process of refining the fluorine gas.

The present invention is a fluorine gas generating apparatus which generates a fluorine gas by electrolyzing hydrogen fluoride in molten salt, including: an electrolytic cell including, above a liquid level of molten salt, a first gas chamber into which a product gas mainly containing the fluorine gas generated at an anode immersed in the molten salt and a second gas chamber which is separated from the first gas chamber and into which a byproduct gas mainly containing a hydrogen gas generated at a cathode immersed in the molten salt; a hydrogen fluoride supply source which retains hydrogen fluoride to be replenished in the electrolytic cell; a refining device which traps a hydrogen fluoride gas evaporated from the molten salt in the electrolytic cell and mixed in the product gas generated from the anode to refine the fluorine gas; and a recovery facility which conveys and recovers the hydrogen fluoride trapped in the refining device in the electrolytic cell or the hydrogen fluoride supply source.

According to the present invention, since hydrogen fluoride trapped in the refining device is recovered in the electrolytic cell or the hydrogen fluoride supply source and reused in order to generate the fluorine gas, hydrogen fluoride which is a component other than the fluorine gas trapped in a process of refining the fluorine gas can be effectively used.

DESCRIPTION OF EMBODIMENTS

Figure 1:
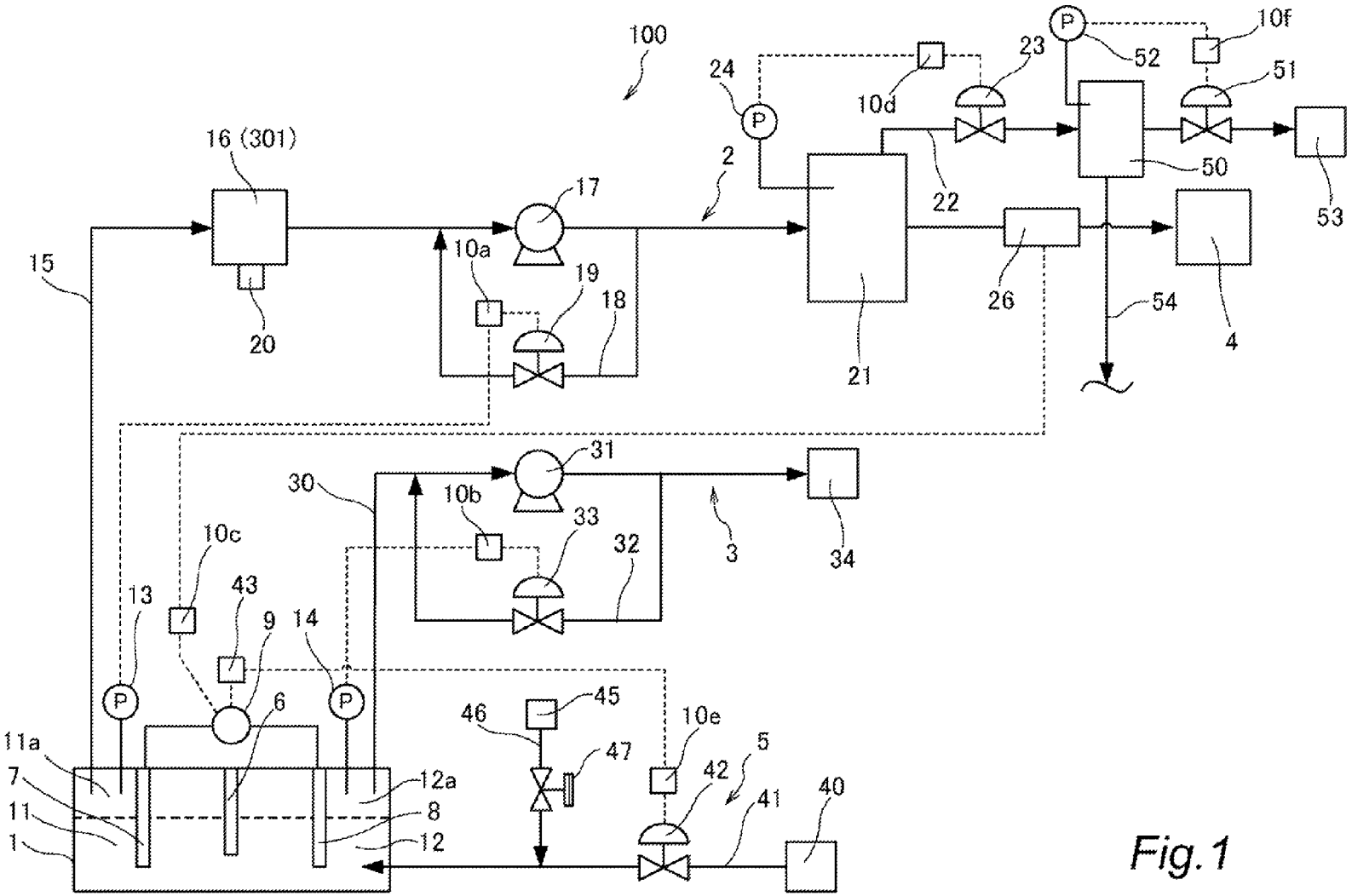
FIG. 1 is a system diagram illustrating a fluorine gas generating apparatus according to a first embodiment of the present invention.

Embodiments of the present invention will be described below by referring to the attached drawings.

First Embodiment

A fluorine gas generating apparatus 100 according to a first embodiment of the present invention will be described by referring to FIG. 1.

The fluorine gas generating apparatus 100 generates a fluorine gas by electrolysis and supplies the generated fluorine gas to an external device 4. The external device 4 is a semiconductor manufacturing device, for example, and in that case, the fluorine gas is used as a cleaning gas in a manufacturing process of a semiconductor, for example.

The fluorine gas generating apparatus 100 includes an electrolytic cell 1 which generates a fluorine gas by electrolysis, a fluorine gas supply system 2 which supplies the fluorine gas generated from the electrolytic cell 1 to the external device 4, and a byproduct gas treatment system 3 which treats a byproduct gas generated with the generation of the fluorine gas.

First, the electrolytic cell 1 will be described.

The electrolytic cell 1 retains molten salt containing hydrogen fluoride (HF). In this embodiment, a mixture (KF·2HF) of hydrogen fluoride and potassium fluoride (KF) is used as the molten salt.

The inside of the electrolytic cell 1 is divided by a partition wall 6 immersed in the molten salt into an anode chamber 11 and a cathode chamber 12. An anode 7 and a cathode 8 are immersed in the anode chamber 11 and the cathode chamber 12, respectively, and by means of supply of an electric current from a power supply 9 between the anode 7 and the cathode 8, a product gas mainly containing a fluorine gas ($F_2$) is generated at the anode 7, while a byproduct gas mainly containing a hydrogen gas ($H_2$) is generated at the cathode 8. A carbon electrode is used for the anode 7, while soft iron, monel or nickel is used for the cathode 8.

On the liquid level of the molten salt in the electrolytic cell 1, a first gas chamber 11*a* into which the fluorine gas generated at the anode 7 is introduced and a second gas chamber 12*a* into which the hydrogen gas generated at the cathode 8 is introduced are divided from each other by a partition wall 6 so that the gases cannot go back and forth between the chambers. As described above, the first gas chamber 11*a* and the second gas chamber 12*a* are fully separated by the partition wall 6 in order to prevent reaction by contact between the fluorine gas and the hydrogen gas. On the other hand, the molten salt of the anode chamber 11 and the cathode chamber 12 is not separated by the partition wall 6 but communicates with each other below the partition wall 6.

The melting point of KF·2HF is 71.7° C., and thus, the temperature of the molten salt is adjusted to 90 to 100° C. Hydrogen fluoride evaporated from the molten salt only by a proportion of a vapor pressure is mixed in each of the fluorine gas and the hydrogen gas generated from the anode 7 and the cathode 8 of the electrolytic cell 1. As described above, a hydrogen fluoride gas is contained in each of the fluorine gas generated at the anode 7 and introduced into the first gas chamber 11*a* and the hydrogen gas generated at the cathode 8 and introduced into the second gas chamber 12*a*.

In the electrolytic cell 1, a first pressure meter 13 which detects a pressure of the first gas chamber 11*a* and a second pressure meter 14 which detects a pressure of the second gas chamber 12*a* are provided. Detection results of the first pressure meter 13 and the second pressure meter 14 are outputted to controllers 10*a* and 10*b*.

Subsequently, the fluorine gas supply system 2 will be described.

A first main passage 15 for supplying the fluorine gas to the external device 4 is connected to the first gas chamber 11*a*.

A first pump 17 which leads the fluorine gas out of the first gas chamber 11*a* and conveys it is provided in the first main passage 15. A positive-displacement pump such as a bellows pump, a diaphragm pump or the like is used for the first pump 17. A first reflux passage 18 which connects a discharge side and a suction side of the first pump 17 is connected to the first main passage 15. A first pressure regulating valve 19 for returning the fluorine gas discharged from the first pump 17 to the suction side of the first pump 17 is provided in the first reflux passage 18.

The first pressure regulating valve 19 has its opening degree controlled by a signal outputted from the controller 10*a*. Specifically, the controller 10*a* controls the opening degree of the first pressure regulating valve 19 on the basis of the detection result of the first pressure meter 13 so that the pressure of the first gas chamber 11*a* becomes a set value determined in advance.

In FIG. 1, the downstream end of the first reflux passage 18 is connected to the vicinity of the first pump 17 in the first main passage 15, but the downstream end of the first reflux passage 18 may be connected to the first gas chamber 11*a*. That is, the fluorine gas discharged from the first pump 17 may be returned into the first gas chamber 11*a*.

A refining device 16 which traps the hydrogen fluoride gas mixed in the product gas and refines the fluorine gas is provided on the upstream of the first pump 17 in the first main passage 15. The refining device 16 is a device which separates the hydrogen fluoride gas from the fluorine gas and traps it by using a difference in a boiling point between fluorine and hydrogen fluoride. The refining device 16 will be described later in detail.

A first buffer tank 21 which retains the fluorine gas conveyed by the first pump 17 is provided on the downstream of the first pump 17 in the first main passage 15. The fluorine gas retained in the first buffer tank 21 is supplied to the external device 4. A flow meter 26 which detects a flow rate of the fluorine gas supplied to the external device 4 is provided on the downstream of the first buffer tank 21. A detection result of the flow meter 26 is outputted to a controller 10*c*. The controller 10*c* controls a current value supplied from the power supply 9 between the anode 7 and the cathode 8 on the basis of the detection result of the flow meter 26. Specifically, a generation amount of the fluorine gas at the anode 7 is controlled so as to replenish the fluorine gas supplied from the first buffer tank 21 to the external device 4.

As described above, since the fluorine gas supplied to the external device 4 is controlled to be replenished, the internal pressure of the first buffer tank 21 is maintained at a pressure higher than the atmospheric pressure. On the other hand, since the external device 4 side where the fluorine gas is used has an atmospheric pressure, the fluorine gas is supplied from the first buffer tank 21 to the external device 4 by a pressure difference between the first buffer tank 21 and the external device 4 by opening the valve provided on the external device 4.

A branch passage 22 is connected to the first buffer tank 21, and a pressure regulating valve 23 which controls the internal pressure of the first buffer tank 21 is provided in the branch passage 22. Moreover, a pressure meter 24 which detects the internal pressure is provided on the first buffer tank 21. A detection result of the pressure meter 24 is outputted to a controller 10*d*. The controller 10*d* opens the pressure regulating valve 23 when the internal pressure of the first buffer tank 21 exceeds a set value determined in advance or specifically, 1.0 MPa and discharges the fluorine gas in the first buffer tank 21. As described above, the pressure regulating valve 23 executes control so that the internal pressure of the first buffer tank 21 does not exceed the predetermined pressure.

A second buffer tank 50 which retains the fluorine gas discharged from the first buffer tank 21 is provided on the downstream of the pressure regulating valve 23 in the branch passage 22. That is, if the internal pressure of the first buffer tank 21 exceeds the predetermined pressure, the fluorine gas in the first buffer tank 21 is discharged through the pressure regulating valve 23, and the discharged fluorine gas is led to the second buffer tank 50. The second buffer tank 50 has a capacity smaller than the first buffer tank 21. A pressure regulating valve 51 which controls the internal pressure of the second buffer tank 50 is provided on the downstream of the second buffer tank 50 in the branch passage 22. Moreover, a pressure meter 52 which detects the internal pressure is provided on the second buffer tank 50. A detection result of the pressure meter 52 is outputted to a controller 10*f*. The controller 10*f* controls an opening degree of the pressure regulating valve 51 so that the internal pressure of the second buffer tank 50 becomes a set value determined in advance. The set value is set at a pressure higher than the atmospheric pressure. The fluorine gas discharged through the pressure regulating valve 51 from the second buffer tank 50 is rendered harmless at an abatement unit 53 and emitted. As described above, the pressure regulating valve 51 executes control so that the internal pressure of the second buffer tank 50 becomes a set value. A fluorine gas supply passage 54 which supplies the fluorine gas to the refining device 16 is connected to the second buffer tank 50.

Subsequently, the byproduct gas treatment system 3 will be described.

A second main passage 30 for discharging the hydrogen gas to the outside is connected to the second gas chamber 12*a*.

A second pump 31 which leads the hydrogen gas out of the second gas chamber 12*a* and conveys it is provided in the second main passage 30. Moreover, a second reflux passage 32 which connects a discharge side and a suction side of the second pump 31 is connected to the second main passage 30. A second pressure regulating valve 33 for returning the hydrogen gas discharged from the second pump 31 to the suction side of the second pump 31 is provided in the second reflux passage 32.

The second pressure regulating valve 33 has its opening degree controlled by a signal outputted from the controller 10*b*. Specifically, the controller 10*b* controls the opening degree of the second pressure regulating valve 33 on the basis of the detection result of the second pressure meter 14 so that the pressure of the second gas chamber 12*a* becomes a set value determined in advance.

As described above, the pressures of the first gas chamber 11*a* and the second gas chamber 12*a* are controlled by the first pressure regulating valve 19 and the second pressure regulating valve 33 so as to be the set values determined in advance, respectively. The set pressures of the first gas chamber 11*a* and the second gas chamber 12*a* are preferably controlled to equal pressures so that there is no difference between the liquid level of the molten salt of the first gas chamber 11*a* and the liquid level of the molten salt of the second gas chamber 12*a*.

An abatement unit 34 is provided on the downstream of the second pump 31 in the second main passage 30, and the hydrogen gas conveyed by the second pump 31 is rendered harmless at the abatement unit 34 and emitted.

The fluorine gas generating apparatus 100 is also provided with a raw material supply system 5 which supplies and replenishes hydrogen fluoride which is the raw material of the fluorine gas into the molten salt in the electrolytic cell 1. The raw material supply system 5 will be described below.

The raw material supply system 5 is provided with a hydrogen fluoride supply source 40 in which hydrogen fluoride to be replenished in the electrolytic cell 1 is retained. The hydrogen fluoride supply source 40 and the electrolytic cell 1 are connected through a raw material supply passage 41. The hydrogen fluoride retained in the hydrogen fluoride supply source 40 is supplied into the molten salt in the electrolytic cell 1 through the raw material supply passage 41. A flow rate control valve 42 for controlling a supply flow rate of hydrogen fluoride is provided in the raw material supply passage 41.

A current integrator 43 which integrates current supplied between the anode 7 and the cathode 8 is mounted on the power supply 9. The current integrated in the current integrator 43 is outputted to a controller 10*e*. The controller 10*e* controls a supply flow rate of the hydrogen fluoride to be led into the molten salt by opening/closing the flow rate control valve 42 on the basis of a signal inputted from the current integrator 43. Specifically, the supply flow rate of hydrogen fluoride is controlled so as to replenish the hydrogen fluoride electrolyzed in the molten salt. More specifically, the supply flow rate of the hydrogen fluoride is controlled so that the concentration of the hydrogen fluoride in the molten salt becomes within a predetermined range.

Moreover, a carrier-gas supply passage 46 which leads a carrier gas supplied from a carrier-gas supply source 45 into the raw material supply passage 41 is connected to the raw material supply passage 41. A shut-off valve 47 which switches between supply and shut-off of the carrier gas is provided in the carrier-gas supply passage 46. The carrier gas is a gas for leading the hydrogen fluoride retained in the hydrogen fluoride supply source 40 into the molten salt in the electrolytic cell 1 and in this embodiment, a nitrogen gas which is an inactive gas is used. During operation of the fluorine gas generating apparatus 100, the shut-off valve 47 is open in principle, and the nitrogen gas is supplied to the cathode chamber 12 of the electrolytic cell 1 together with the hydrogen fluoride. The nitrogen gas is hardly dissolved in the molten salt and is discharged from the second gas chamber 12*a* through the byproduct gas treatment system 3.

As described above, since the nitrogen gas is supplied into the molten salt of the electrolytic cell 1, there is a concern that the liquid level of the molten salt in the electrolytic cell 1 is pushed up by the nitrogen gas. Thus, it may be so configured that a liquid level meter which detects the liquid level is provided in the electrolytic cell 1, a fluctuation margin is set for the liquid level of the molten salt of the electrolytic cell 1 and the shut-off valve 47 is on/off controlled so that the liquid level of the molten salt is contained in the fluctuation margin. That is, it may be configured that the shut-off valve 47 is closed if the liquid level of the molten salt in the electrolytic cell 1 reaches the upper limit of the fluctuation margin.

A flow rate control valve capable of controlling a flow rate of the nitrogen gas may be provided instead of the shut-off valve 47.

Subsequently, overall control of the fluorine gas generating apparatus 100 configured as above will be described.

The flow rate of the fluorine gas used in the external device 4 is detected by the flow meter 26 provided between the first buffer tank 21 and the external device 4. A voltage to be applied between the anode 7 and the cathode 8 is controlled on the detection result of the flow meter 26, and a generation amount of the fluorine gas in the anode 7 is controlled. The hydrogen fluoride in the molten salt decreased by the electrolysis is replenished from the hydrogen fluoride supply source 40.

As described above, since control is executed so that the hydrogen fluoride in the molten salt is replenished in accordance with the fluorine gas amount used in the external device 4, the liquid level of the molten salt does not usually change greatly. However, if a use amount of the fluorine gas in the external device 4 is rapidly changed or if the pressure of the hydrogen gas in the byproduct gas treatment system 3 is rapidly changed, the pressures of the first gas chamber 11*a* and the second gas chamber 12*a* are significantly changed and the liquid levels of the anode chamber 11 and the cathode chamber 12 are significantly fluctuated. If the liquid levels of the anode chamber 11 and the cathode chamber 12 are significantly fluctuated, and if the liquid level falls below the partition wall 6, the first gas chamber 11*a* and the second gas chamber 12*a* communicate with each other. In that case, the fluorine gas and the hydrogen gas are mixed and reacted.

Thus, in order to suppress fluctuation of the liquid levels of the anode chamber 11 and the cathode chamber 12, the pressures of the first gas chamber 11*a* and the second gas chamber 12*a* are controlled so as to become the set values determined in advance on the basis of the detection results of the first pressure meter 13 and the second pressure meter 14, respectively. As described above, the liquid levels of the anode chamber 11 and the cathode chamber 12 are controlled by maintaining the pressures of the first gas chamber 11*a* and the second gas chamber 12*a* constant.

Figure 2:
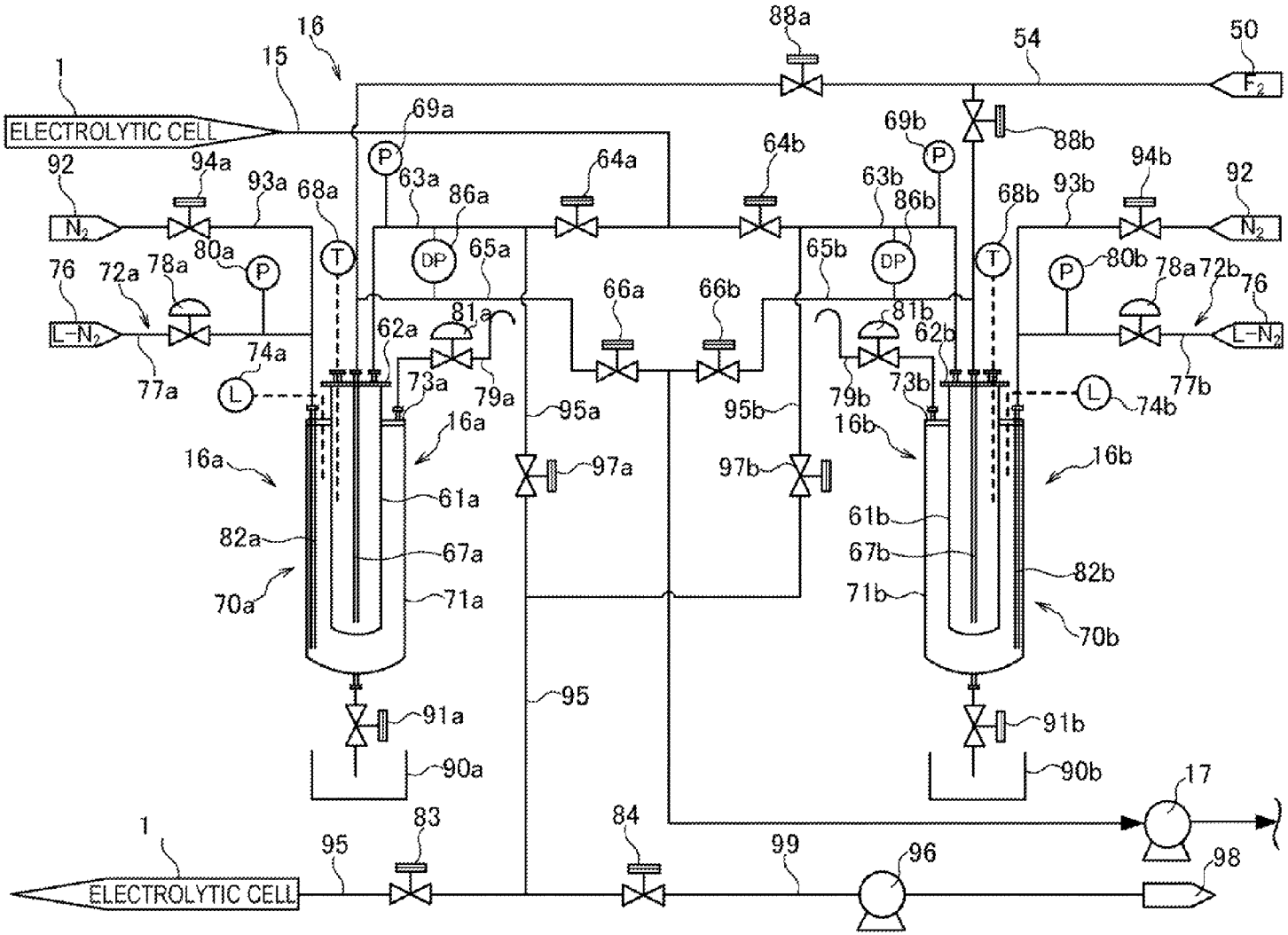
FIG. 2 is a system diagram of a refining device in the fluorine gas generating apparatus according to the first embodiment of the present invention.

Subsequently, the refining device 16 will be described by referring to FIG. 2.

The refining device 16 is composed of two systems, that is, a first refining device 16*a* and a second refining device 16*b* provided in parallel, and can be switched so that the fluorine gas passes through only one of the systems. That is, when one of the first refining device 16*a* and the second refining device 16*b* is in an operating state, the other is stopped or in a standby state. In this embodiment, two units of the refining devices 16 are arranged in parallel, but three or more refining devices 16 may be arranged in parallel.

Since the first refining device 16*a* and the second refining device 16*b* have the same configuration, the first refining device 16*a* will be mainly described below, and the same reference numeral are given to the same configurations in the second refining device 16*b* as those in the first refining device 16*a*, and the description will be omitted. The configurations of the first refining device 16*a* are suffixed by "a" and the configurations of the second refining device 16*b* are suffixed by "b" for discrimination.

The first refining device 16*a* includes an inner tube 61*a* as a gas inflow unit into which the fluorine gas containing the hydrogen fluoride gas flows and a cooling device 70*a* which cools the inner tube 61*a* at a temperature not lower than the boiling point of fluorine and not higher than the melting point of hydrogen fluoride so that the fluorine gas passes through the inner tube 61*a* while the hydrogen fluoride gas mixed in the fluorine gas is coagulated.

The inner tube 61*a* is a bottomed cylindrical member, and an upper opening thereof is sealed by a lid member 62*a*. An inlet passage 63*a* which leads the fluorine gas generated in the anode 7 into the inner tube 61*a* is connected to the lid member 62*a* of the inner tube 61*a*. The inlet passage 63*a* is one of two passages which are branched off the first main passage 15, and the other inlet passage 63*b* is connected to an inner tube 61*b* of the second refining device 16*b*. An inlet valve 64*a* which allows or shuts off inflow of the fluorine gas into the inner tube 61*a* is provided in the inlet passage 63*a*.

A conduit 67*a* provided by being suspended into the inner tube 61*a* is connected to the inner surface of the lid member 62*a* of the inner tube 61*a*. The conduit 67*a* is formed by having a length such that a lower end opening unit is located in the vicinity of the bottom part of the inner tube 61*a*. An upper end unit of the conduit 67*a* is connected to an outlet passage 65*a* connected to the lid member 62*a* and discharging the fluorine gas through the inner tube 61*a*. Therefore, the fluorine gas in the inner tube 61*a* flows out to the outside through the conduit 67*a* and the outlet passage 65*a*. An outlet valve 66*a* which allows or shuts off outflow of the fluorine gas from the inner tube 61*a* is provided in the outlet passage 65*a*. The outlet passage 65*a* merges with an outlet passage 65*b* of the second refining device 16*b* and is connected to the first pump 17.

As described above, the fluorine gas generated in the anode 7 flows into the inner tube 61*a* through the inlet passage 63*a* and flows out of the inner tube 61*a* through the conduit 67*a* and the outlet passage 65*a*.

When the first refining device 16*a* is in the operating state, the inlet valve 64*a* and the outlet valve 66*a* are open, while when the first refining device 16*a* is in the stop or standby state, the inlet valve 64*a* and the outlet valve 66*a* are closed.

A thermometer 68*a* which detects an internal temperature is provided in the inner tube 61*a* by being inserted through the lid member 62*a*. Moreover, a pressure meter 69*a* which detects the internal pressure of the inner tube 61*a* is provided in the inlet passage 63*a*.

The cooling device 70*a* includes a jacket tube 71*a* capable of partially containing the inner tube 61*a* and capable of retaining liquid nitrogen as a cooling medium therein, and a liquid nitrogen supply/discharge system 72*a* which supplies/discharges liquid nitrogen to/from the jacket tube 71*a*.

The jacket tube 71*a* is a bottomed cylindrical member, and an upper opening is sealed by a lid member 73*a*. The inner tube 61*a* is coaxially contained in the jacket tube 71*a* in a state having the upper part side protruding from the lid member 73*a*. Specifically, 80 to 90% of the inner tube 61*a* is contained in the jacket tube 71*a*.

Subsequently, the liquid nitrogen supply/discharge system 72*a* will be described.

A liquid nitrogen supply passage 77*a* which leads the liquid nitrogen supplied from a liquid nitrogen supply source 76 into the jacket tube 71*a* is connected to the lid member 73*a* of the jacket tube 71*a*. A conduit 82*a* provided by being suspended into the jacket tube 71*a* is connected to the inner surface of the lid member 73*a* of the jacket tube 71*a*, and an upper end unit of the conduit 82*a* is connected to the liquid nitrogen supply passage 77*a*. Therefore, the liquid nitrogen supplied from the liquid nitrogen supply source 76 is led into the jacket tube 71*a* through the liquid nitrogen supply passage 77*a* and the conduit 82*a*. The conduit 82*a* is formed having a length such that a lower end opening unit is located in the vicinity of the bottom part of the jacket tube 71*a*.

A flow rate control valve 78*a* which controls the supply flow rate of the liquid nitrogen is provided in the liquid nitrogen supply passage 77*a*. A pressure meter 80*a* which detects an internal pressure of the jacket tube 71*a* is provided on the downstream of the flow rate control valve 78*a* in the liquid nitrogen supply passage 77*a*.

The inside of the jacket tube 71*a* is formed of two layers, that is, the liquid nitrogen and evaporated nitrogen gas, and the liquid level of the liquid nitrogen is detected by a liquid level meter 74*a* provided by being inserted through the lid member 73*a*.

A nitrogen gas discharge passage 79*a* for discharging the nitrogen gas in the jacket tube 71*a* is connected to the lid member 73*a* of the jacket tube 71*a*. A pressure regulating valve 81*a* which controls the internal pressure of the jacket tube 71*a* is provided in the nitrogen gas discharge passage 79*a*. The pressure regulating valve 81*a* executes control such that the internal pressure of the jacket tube 71*a* becomes a predetermined pressure determined in advance on the basis of a detection result of the pressure meter 80*a*. This predetermined pressure is determined so that the temperature of the liquid nitrogen in the jacket tube 71*a* becomes not lower than the boiling point of fluorine (−188° C.) and not higher than the melting point of hydrogen fluoride (−84° C.). Specifically, the pressure is set to 0.4 MPa so that the temperature of the liquid nitrogen in the jacket tube 71*a* becomes approximately −180° C. As described above, the pressure regulating valve 81*a* controls the internal pressure of the jacket tube 71*a* to 0.4 MPa so that the temperature of the liquid nitrogen in the jacket tube 71*a* is maintained at approximately −180° C. The nitrogen gas discharged through the pressure regulating valve 81*a* is emitted to the outside.

When the liquid nitrogen in the jacket tube 71*a* is evaporated and emitted to the outside, the liquid nitrogen in the jacket tube 71*a* decreases. Thus, the flow rate control valve 78*a* controls the supply flow rate of the liquid nitrogen from the liquid nitrogen supply source 76 to the jacket tube 71*a* so that the liquid level of the liquid nitrogen in the jacket tube 71*a* is maintained constant.

An insulating material for heat-retention or a vacuum insulation layer may be provided outside the jacket tube 71*a* in order to suppress heat transfer between the jacket tube 71*a* and the outside.

Since the inner tube 61*a* is cooled by the jacket tube 71*a* to a temperature not lower than the boiling point of fluorine and not higher than the melting point of hydrogen fluoride, only hydrogen fluoride mixed in the fluorine gas is coagulated in the inner tube 61*a*, and the fluorine gas passes through the inner tube 61*a*. As described above, the hydrogen fluorine gas can be trapped in the inner tube 61*a*. Since the fluorine gas is continuously led from the electrolytic cell 1 into the inner tube 61*a*, the coagulated hydrogen fluoride accumulates in the inner tube 61*a* as time elapses. When the accumulated amount of the coagulated hydrogen fluoride reaches a predetermined amount, the operation of the first refining device 16*a* is stopped, the second refining device 16*b* in the standby state is started, and operation of the refining device 16 is switched. The operation switching will be described later in detail.

Whether or not the accumulated amount of the coagulated hydrogen fluoride has reached the predetermined amount is determined on the basis of a detection result of a differential pressure meter 86*a* provided over the inlet passage 63*a* and the outlet passage 65*a* of the inner tube 61*a*, that is, a differential pressure between the inlet and the outlet of the inner tube 61*a*. When the differential pressure between the inlet and the outlet of the inner tube 61*a* reaches the predetermined value, it is determined that the accumulated amount of the coagulated hydrogen fluoride in the inner tube 61*a* has reached the predetermined amount, and the first refining device 16*a* is stopped. The differential pressure meter 86*a* corresponds to an accumulated state detector which detects an accumulated state of the hydrogen fluoride in the inner tube 61*a*. The accumulated state of the hydrogen fluoride in the inner tube 61*a* may be detected by the pressure meter 69*a* instead of the differential pressure meter.

The first refining device 16*a* is stopped by closing the inlet valve 64*a* and the outlet valve 66*a* of the inner tube 61*a*. After the first refining device 16*a* is stopped, the hydrogen fluoride trapped in the inner tube 61*a* is conveyed and recovered in the electrolytic cell 1, and the first refining device 16*a* is regenerated and enters the standby state. As described above, the first refining device 16*a* is also provided with a recovery facility which conveys and recovers the hydrogen fluoride trapped in the inner tube 61*a* into the electrolytic cell 1 and a regeneration facility which recycles the first refining device 16*a*. The recovery facility and the regeneration facility will be described below.

A discharge valve 91*a* that can discharge liquid nitrogen in the jacket tube 71*a* into an external tank 90*a* is provided on the bottom part of the jacket tube 71*a*. Moreover, a nitrogen gas supply passage 93*a* which leads the nitrogen gas supplied from a nitrogen gas supply source 92 into the jacket tube 71*a* is connected to the downstream of the flow rate control valve 78*a* in the liquid nitrogen supply passage 77*a*. A shut-off valve 94*a* which switches between supply and shut-off of the nitrogen gas to the jacket tube 71*a* is provided in the nitrogen gas supply passage 93*a*. The supply of the nitrogen gas from the nitrogen gas supply source 92 to the jacket tube 71*a* is performed while the discharge valve 91*a* is fully open and the flow rate control valve 78*a* is fully closed. A gas at a normal temperature is used as the nitrogen gas.

As described above, cooling of the inner tube 61*a* is cancelled by supplying the nitrogen gas at a normal temperature while the liquid nitrogen in the jacket tube 71*a* is discharged. With that, the hydrogen fluoride accumulated in the coagulated state in the inner tube 61*a* is dissolved.

A lower end of the fluorine gas supply passage 54 connected to the second buffer tank 50 (See FIG. 1) is connected to the upstream of the outlet valve 66*a* in the outlet passage 65*a*. A shut-off valve 88*a* which switches between supply and shut-off of the fluorine gas into the inner tube 61*a* is provided in the fluorine gas supply passage 54.

The internal pressure of the second buffer tank 50 is controlled to a pressure higher than the atmospheric pressure by the pressure regulating valve 51 (See FIG. 1). Therefore, the fluorine gas retained in the second buffer tank 50 is supplied to the inner tube 61*a* by opening the shut-off valve 88*a* due to the differential pressure between the second buffer tank 50 and the inner tube 61*a*.

A conveying passage 95*a* which discharges and conveys dissolved hydrogen fluoride in the inner tube 61*a* is connected to the downstream of the inlet valve 64*a* in the inlet passage 63*a*. The conveying passage 95*a* merges with a conveying passage 95*b* of the second refining device 16*b* and become a merged conveying passage 95, and a downstream end of the merged conveying passage 95 is connected to the electrolytic cell 1. Discharge valves 97*a* and 97*b* opened when the hydrogen fluoride is discharged are provided in the conveying passages 95*a* and 95*b*, respectively. Moreover, a shut-off valve 83 which opens when the hydrogen fluoride is conveyed to the electrolytic cell 1 from the inner tube 61*a* is provided in the merged conveying passage 95.

A branch passage 99 is connected to the upstream of the shut-off valve 83 in the merged conveying passage 95, and a vacuum pump 96 which deaerates the inside of the jacket tube 71*a* is provided in the branch passage 99. A shut-off valve 84 which opens when the inside of the jacket tube 71*a* is deaerated is provided on the upstream of the vacuum pump 96 in the branch passage 99. Moreover, an abatement unit 98 is provided on the downstream end of the branch passage 99.

The hydrogen fluoride dissolved in the inner tube 61*a* is recovered in the electrolytic cell 1 by supplying the fluorine gas into the inner tube 61*a* through the fluorine gas supply passage 54 and by being conveyed through the conveying passage 95*a* and the merged conveying passage 95. As described above, the dissolved hydrogen fluoride in the inner tube 61*a* is accompanied by the fluorine gas by supplying the fluorine gas into the inner tube 61*a* as a carrier gas and is recovered in the electrolytic cell 1. Since the fluorine gas is used as a carrier gas, the hydrogen fluoride conveyed through the merged conveying passage 95 is recovered into the anode chamber 11 of the electrolytic cell 1.

After the hydrogen fluoride in the inner tube 61*a* is discharged, it is necessary to fill the fluorine gas into the inner tube 61*a* and to regenerate the first refining device 16*a*. This is because, when the accumulated amount of the coagulated hydrogen fluoride in the inner tube 61*b* reaches the predetermined amount while the second refining device 16*b* is operating, an operation can be quickly switched to the first refining device 16*a*.

Here, if the fluorine gas is used as a carrier gas, filling of the fluorine gas into the inner tube 61*a*, that is, regeneration of the first refining device 16*a* is completed at the same time as when discharge of the dissolved hydrogen fluoride in the inner tube 61*a* is completed.

As described above, the fluorine gas retained in the second buffer tank 50 is used for discharge of the dissolved hydrogen fluoride in the inner tube 61*a*, conveying it to the electrolytic cell 1, and filling of the fluorine gas into the inner tube 61*a*. The fluorine gas retained in the first buffer tank 21 may be used instead of the fluorine gas retained in the second buffer tank 50. In that case, the fluorine gas supply passage 54 is connected to the first buffer tank 21. However, in this case, the pressure of the first buffer tank 21 can fluctuate easily, and the pressure of the fluorine gas to be supplied to the external device 4 may fluctuate. Therefore, as in this embodiment, use of the fluorine gas retained in the second buffer tank 50 is more preferable.

Subsequently, the operation of the refining device 16 configured as above will be described. The operation of the refining device 16 is controlled by a controller 20 (See FIG. 1) as a controller mounted on the fluorine gas generating apparatus 100. The controller 20 controls an operation of each valve and each pump on the basis of detection results of the thermometers 68*a* and 68*b*, the pressure meters 69*a* and 69*b*, the liquid level meters 74*a* and 74*b*, the pressure meters 80*a* and 80*b*, and the differential pressure meters 86*a* and 86*b*.

The case in which the first refining device 16*a* is in the operating state and the second refining device 16*b* is in the standby state will be described. In the first refining device 16*a*, the inlet valve 64*a* and the outlet valve 66*a* of the inner tube 61*a* is in the open state, and the fluorine gas is continuously led from the electrolytic cell 1 into the inner tube 61*a*. On the other hand, in the second refining device 16*b*, the inlet valve 64*b* and the outlet valve 66*b* of the inner tube 61*b* are in the closed state, and the fluorine gas is filled in the inner tube 61*b*. As described above, the fluorine gas generated in the electrolytic cell 1 passes only through the first refining device 16*a*.

In the following, the first refining device 16*a* in the operating state will be described.

The liquid nitrogen lead through the liquid nitrogen supply passage 77*a* is retained in the jacket tube 71*a* of the first refining device 16*a* so that the inner tube 61*a* is cooled by the liquid nitrogen. The internal pressure of the jacket tube 71*a* is controlled by the pressure regulating valve 81*a* to 0.4 MPa. As a result, since the temperature of the liquid nitrogen in the jacket tube 71*a* is maintained at approximately −180° C. which is the temperature not lower than the boiling point of fluorine and not higher than the melting point of hydrogen fluoride, only the hydrogen fluoride is coagulated in the inner tube 61*a*, while the fluorine gas passes through the inner tube 61*a* and is conveyed by the first pump 17 to the first buffer tank 21.

Here, the fluorine gas generated in the electrolytic cells 1 flows into the inner tube 61*a* through the inlet passage 63*a* and flows out of the inner tube 61*a* through the conduit 67*a* and the outlet passage 65*a*. A lower end opening unit of the conduit 67*a* is located in the vicinity of the bottom part of the inner tube 61*a*, and thus, the fluorine gas flows from the upper part of the inner tube 61*a* and flows out of the lower part of the inner tube 61*a*. Therefore, the fluorine gas is sufficiently cooled while passing through the inner tube 61*a*, and hydrogen fluoride in the fluorine gas can be reliably coagulated and trapped.

Since the fluorine gas is continuously led from the electrolytic cell 1 into the inner tube 61*a*, the liquid nitrogen in the jacket tube 71*a* for cooling the fluorine gas is also continuously evaporated. The evaporated nitrogen gas is emitted to the outside through the pressure regulating valve 81*a*.

When the accumulated amount of the coagulated hydrogen fluoride in the inner tube 61*a* increases and the differential pressure between the inlet and the outlet of the inner tube 61*a* detected by the differential pressure meter 86*a* reaches the predetermined value, the operation of the first refining device 16*a* is stopped, and the second refining device 16*b* in the standby state is started so that operation of the refining device 16 is switched. In the first refining device 16*a*, the recovery process of the trapped hydrogen fluoride and the regeneration process are performed in the first refining device 16*a*.

Figure 3:
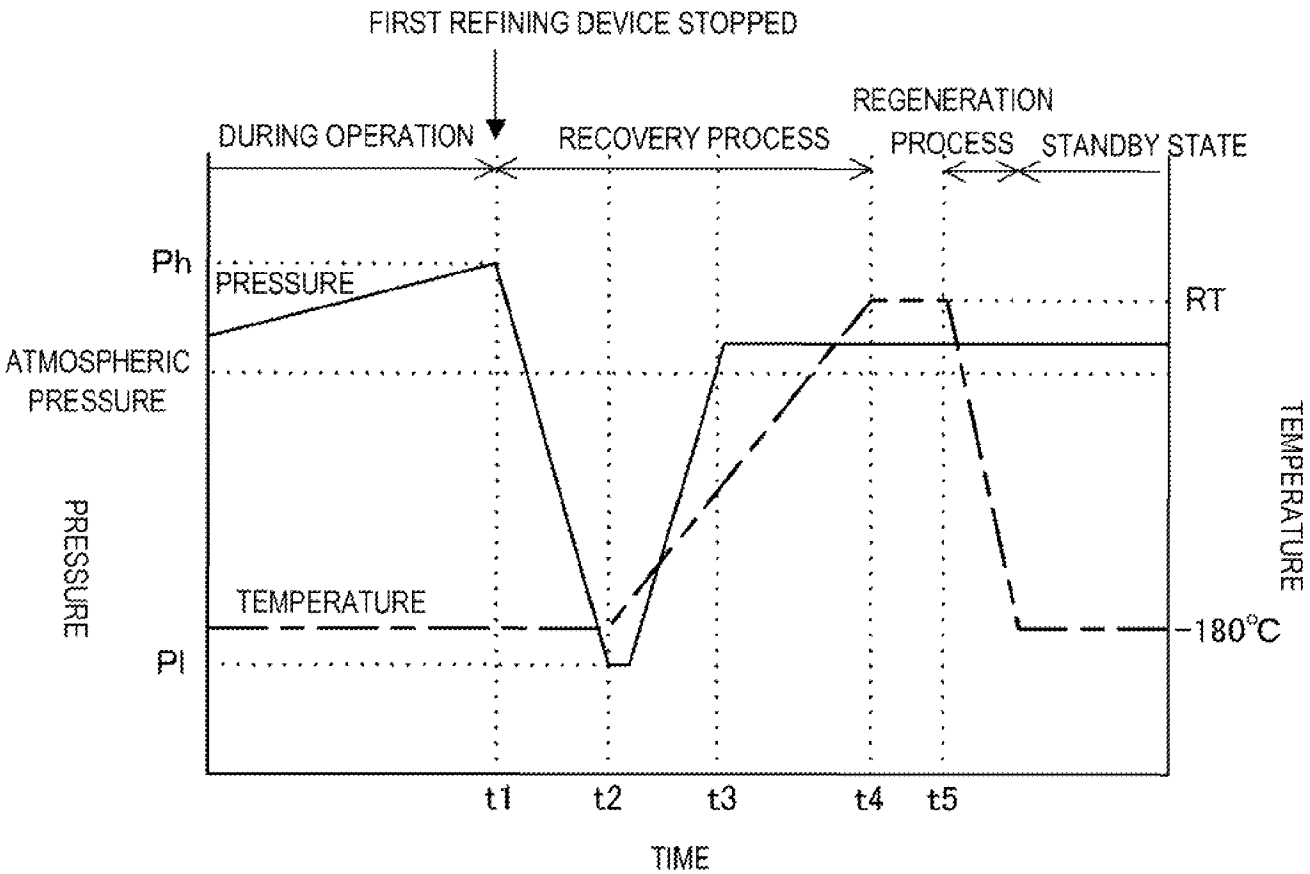
FIG. 3 is a graph illustrating temporal changes of a pressure and a temperature in an inner tube of the refining device, in which a solid line indicates the pressure and an alternate long and short dash line indicates the temperature.

The operation switching process from the first refining device 16*a* to the second refining device 16*b*, the recovery process of the hydrogen fluoride trapped in the first refining device 16*a*, and the regeneration process of the first refining device 16*a* will be described below by referring to FIGS. 2 and 3. FIG. 3 is a graph illustrating temporal changes of the pressure and the temperature of the inner tube 61*a* of the first refining device 16*a*, in which a solid line indicates the pressure, and an alternate long and short dash line indicates the temperature. The pressure illustrated in FIG. 3 is detected by the pressure meter 69*a*, and the temperature is detected by the thermometer 68*a*.

As illustrated in FIG. 3, if the accumulated amount of the coagulated hydrogen fluoride in the inner tube 61*a* increases, the internal pressure of the inner tube 61*a* rises. When the internal pressure of the inner tube 61*a* reaches the predetermined pressure (Ph) and the differential pressure between the inlet and the outlet of the inner tube 61*a* detected by the differential pressure meter 86*a* reaches the predetermined value, the operation is switched from the first refining device 16*a* to the second refining device 16*b* (time t1). Specifically, after the inlet valve 64*b* and the outlet valve 66*b* of the inner tube 61*b* of the second refining device 16*b* are opened, the inlet valve 64*a* and the outlet valve 66*b* of the inner tube 61*a* of the first refining device 16*a* are closed. As a result, the second refining device 16*b* is started, the first refining device 16*a* is stopped, and the fluorine gas from the electrolytic cell 1 is led to the second refining device 16*b*.

In the stopped first refining device 16*a*, the recovery process of the trapped hydrogen fluoride is performed in compliance with the following procedure:

First, the discharge valve 97*a* of the conveying passage 95*a* and the shut-off valve 84 of the branch passage 99 are opened, and the fluorine gas in the inner tube 61*a* is suctioned by the vacuum pump 96, rendered harmless in the abatement unit 98 and emitted. At the time when the internal pressure of the inner tube 61*a* lowers to a predetermined pressure P1 (not more than 100 Pa) not more than the atmospheric pressure (time t2), the shut-off valve 84 is closed, and deaeration inside the inner tube 61*a* is completed. Since the hydrogen fluoride in the inner tube 61*a* is in the coagulated state, it is not suctioned by the vacuum pump 96.

When the deaeration of the inside of the inner tube 61*a* is completed, the flow rate control valve 78*a* of the liquid nitrogen supply passage 77*a* is fully closed, supply of the liquid nitrogen to the jacket tube 71*a* is stopped, and then, the discharge valve 91*a* is fully opened to discharge the liquid nitrogen. After that, the shut-off valve 94*a* of the nitrogen gas supply passage 93*a* is opened, and the nitrogen gas at a normal temperature is supplied to the jacket tube 71*a*. As a result, as illustrated in FIG. 3, the temperature in the inner tube 61*a* rises, and the hydrogen fluoride in the inner tube 61*a* is dissolved.

Moreover, at the same time as the discharge of the liquid nitrogen in the jacket tube 71*a*, the shut-off valve 88*a* of the fluorine gas supply passage 54 is opened so that the fluorine gas is supplied into the inner tube 61*a* as a carrier gas. As a result, the internal pressure of the inner tube 61*a* rises.

At the time when the internal pressure of the inner tube 61*a* reaches the atmospheric pressure which is the same pressure as in the electrolytic cell 1 (time t3), the shut-off valve 83 of the merged conveying passage 95 is opened, and the dissolved hydrogen fluoride in the inner tube 61*a* is accompanied by the fluorine gas and conveyed to the anode chamber 11 of the electrolytic cell 1. As a result, the dissolved hydrogen fluoride in the inner tube 61*a* is recovered in the electrolytic cell 1.

At the time when the temperature in the inner tube 61*a* reaches a normal temperature (RT) (time t4), the shut-off valve 83 and the shut-off valve 88*a* are closed, and the conveying of the hydrogen fluoride to the electrolytic cell 1 and the supply of the fluorine gas as a carrier gas into the inner tube 61*a* are stopped.

As above, the recovery process of the trapped hydrogen fluoride is completed. In the above-described recovery process, since the carrier gas is the fluorine gas, the deaeration inside the inner tube 61*a* by the vacuum pump 96 performed at the beginning of the recovery process does not necessarily have to be done. That is, the dissolved hydrogen fluoride may be conveyed to the electrolytic cell 1 by supplying the fluorine gas as a carrier gas into the inner tube 61*a* at the same time as the discharge of the liquid nitrogen in the jacket tube 71*a* without performing the deaeration in the inner tube 61*a*. However, if the deaeration in the inner tube 61*a* is not performed at the beginning of the recovery process, the other micro components in the fluorine gas in the inner tube 61*a* are also recovered into the electrolytic cell 1, and the other micro components might be concentrated. Therefore, in order to avoid such a situation, the inner tube 61*a* is preferably deaerated.

Subsequently, the regeneration process of the first refining device 16*a* is performed in compliance with the following procedure:

First, while the discharge valve 91*a* and the shut-off valve 94*a* of the nitrogen gas supply passage 93*a* are fully closed, the flow rate control valve 78*a* of the liquid nitrogen supply passage 77*a* is opened to supply the liquid nitrogen into the jacket tube 71*a* (time t5). As a result, the internal temperature of the inner tube 61*a* lowers. The internal pressure of the jacket tube 71*a* is controlled by the pressure regulating valve 81*a* to 0.4 MPa, and thus, the internal temperature of the inner tube 61*a* is lowered to approximately −180° C. and is maintained at the temperature.

At the time when the recovery process is completed, the fluorine gas supplied as a carrier gas has been already filled in the inner tube 61*a*, but the volume of the fluorine gas in the inner tube 61*a* is reduced by the supply of the liquid nitrogen to the jacket tube 71*a*. Thus, the internal pressure of the inner tube 61*a* may fall below the atmospheric pressure. In that case, the shut-off valve 88*a* of the fluorine gas supply passage 54 is opened, and the fluorine gas is filled in the inner tube 61*a*. At the time when the recovery process is finished (time t4), it may be so configured that the shut-off valve 88*a* is not closed, but the shut-off valve 88*a* is open all the time during the regeneration process and closed when the internal temperature of the inner tube 61*a* reaches −180° C.

In this way, the regeneration process of the first refining device 16*a* is completed, and the first refining device 16*a* enters the standby state.

As described above, while the first refining device 16*a* is stopped, the inner tube 61*a* is cooled to −180° C. and enters the standby state in which the fluorine gas is filled in the inner tube 61*a*. Therefore, if the differential pressure between the inlet and the outlet of the inner tube 61*b* in the second refining device 16*b* during operation reaches the predetermined value, the operation of the second refining device 16*b* is stopped, and the first refining device 16*a* is quickly started so that the operation of the refining device 16 can be switched.

According to the above-described embodiment, the following working effects are exerted.

The hydrogen fluoride trapped in the refining device 16 is recovered in the electrolytic cell 1 and reused for regeneration of a fluorine gas, and thus, the hydrogen fluoride which is a component other than the fluorine gas trapped in the process of refining the fluorine gas can be effectively used.

Moreover, the fluorine gas generated in the electrolytic cell 1 is used as the carrier gas for conveying the hydrogen fluoride trapped in the refining device 16 to the electrolytic cell 1. Therefore, a dedicated carrier gas is no longer necessary, and a gas facility for that is not needed, either, so the fluorine gas generating apparatus 100 can be formed in a compact manner and a cost can be reduced. Moreover, the fluorine gas retained in the second buffer tank 50 is used for the fluorine used as the carrier gas. The second buffer tank 50 is a tank for retaining the fluorine gas discharged with control of the internal pressure of the first buffer tank 21. That is, the fluorine gas having been emitted from the first buffer tank to the outside in the prior-art technology is retained in the second buffer tank 50, and the retained fluorine gas is used as the carrier gas. Therefore, the fluorine gas can be effectively used, and also, the emission of the fluorine gas to the outside and the fluorine gas amount treated in the abatement unit 53 are reduced, thereby reducing a load of the abatement unit 53.

Moreover, the refining device 16 is composed of at least two systems, and the refining device 16 of the system stopped by the operation switching is regenerated after the hydrogen fluoride is discharged from the inner tubes 61*a* and 61*b* and then, enters the standby state. Thus, the refining device 16 can be operated any time. Therefore, when the accumulated amount of the hydrogen fluoride coagulated in the refining device 16 of the operating system becomes large, the refining device 16 of the system in the standby state can be started quickly. Therefore, there is no need to stop the fluorine gas generating apparatus 100, and the fluorine gas can be supplied stably to the external device 4.

Another mode of the first embodiment will be described below.

In the above-described first embodiment, a mode in which the fluorine gas is used as a carrier gas in the recovery facility for conveying and recovering the hydrogen fluoride trapped in the inner tubes 61*a* and 61*b* into the electrolytic cell 1 has been described.

Figure 4:
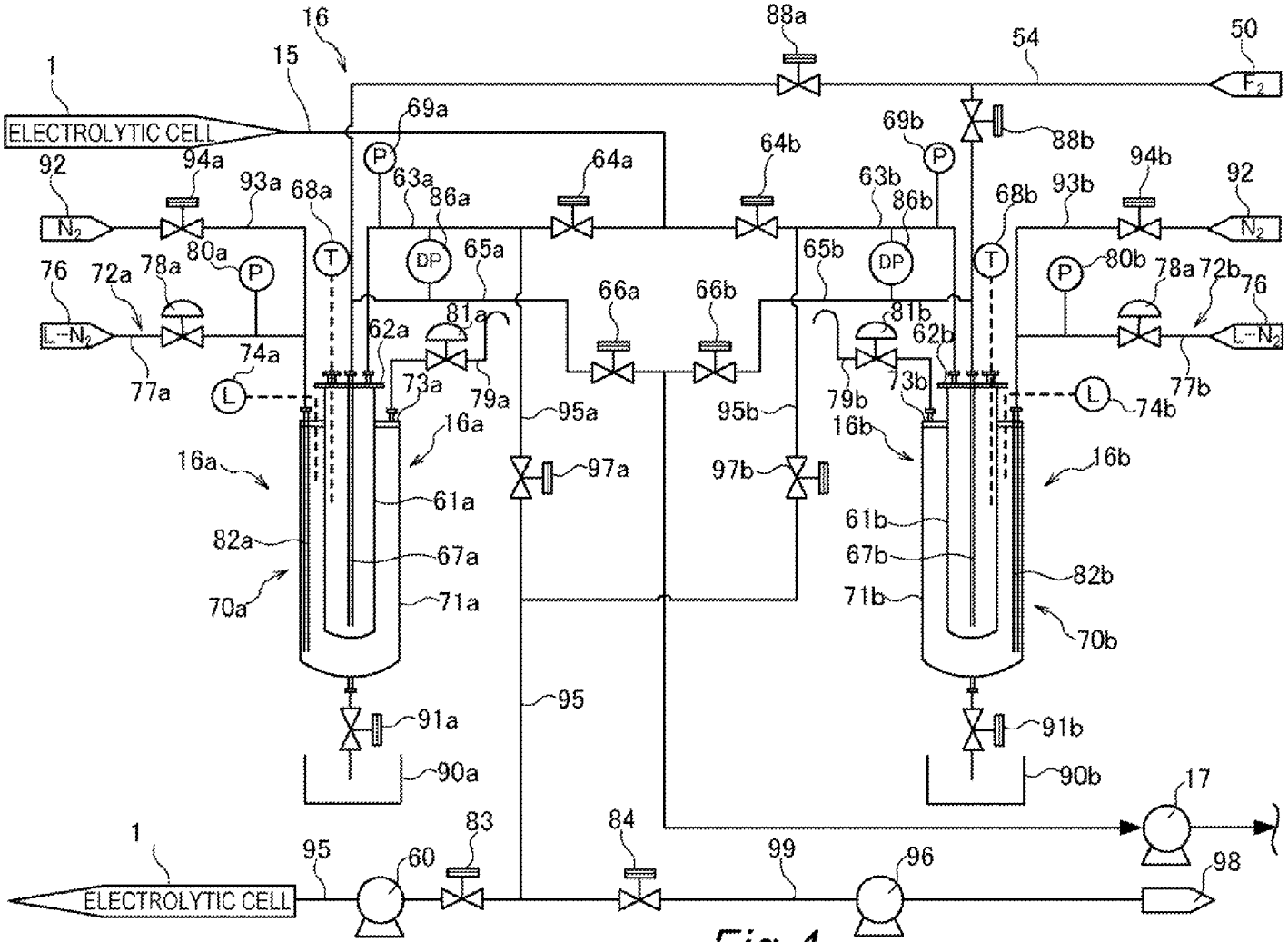
FIG. 4 is a system diagram of another embodiment of a fluorine gas generating apparatus according to the first embodiment of the present invention.

As another configuration of the recovery facility, as illustrated in FIG. 4, it may be so configured that a conveying pump 60 as a suction device is provided on the downstream of the shut-off valve 83 in the merged conveying passage 95 so as to suction the insides of the inner tubes 61*a* and 61*b* by the conveying pump 60 without using a carrier gas and to convey and recover the hydrogen fluoride into the anode chamber 11 of the electrolytic cell 1.

As a procedure of the recovery process, the conveying pump 60 is driven with the opening of the shut-off valve 83 at the same time as the discharge of the liquid nitrogen in the jacket tube 71*a*, whereby the dissolved hydrogen fluoride in the inner tube 61*a* is conveyed to the electrolytic cell 1. This point is different from the procedure illustrated in the above-described first embodiment. That is, the trapped hydrogen fluoride is conveyed to the electrolytic cell 1 by suctioning the insides of the inner tubes 61*a* and 61*b* by the conveying pump 60 while the cooling of the inner tubes 61*a* and 61*b* is cancelled.

In the case of this configuration, the supply of the fluorine gas through the fluorine gas supply passage 54 is performed only when the fluorine gas is filled in the inner tubes 61*a* and 61*b* in the recovery process.

If the hydrogen fluoride is recovered by using the conveying pump 60 without using a carrier gas, by deaerating the fluorine gas in the inner tube 61*a* by the vacuum pump 96 before the cooling of the inner tubes 61*a* and 61*b* is canceled, only the hydrogen fluoride is recovered. Therefore, the destination of recovery of the hydrogen fluoride may be the hydrogen fluoride supply source 40 instead of the electrolytic cell 1. That is, the hydrogen fluoride trapped in the inner tubes 61*a* and 61*b* may be conveyed and recovered in the hydrogen fluoride supply source 40.

Second Embodiment

A fluorine gas generating apparatus 200 according to a second embodiment of the present invention will be described by referring to FIGS. 5 *and* 6.

Differences from the above-described first embodiment will be mainly described below, and the same reference numerals are given to the same configuration as those in the first embodiment, and the description will be omitted.

In the fluorine gas generating apparatus 200, the configuration of the byproduct gas treatment system 3 is partially different from that of the first embodiment. That point will be described below by referring to FIG. 5.

Figure 5:
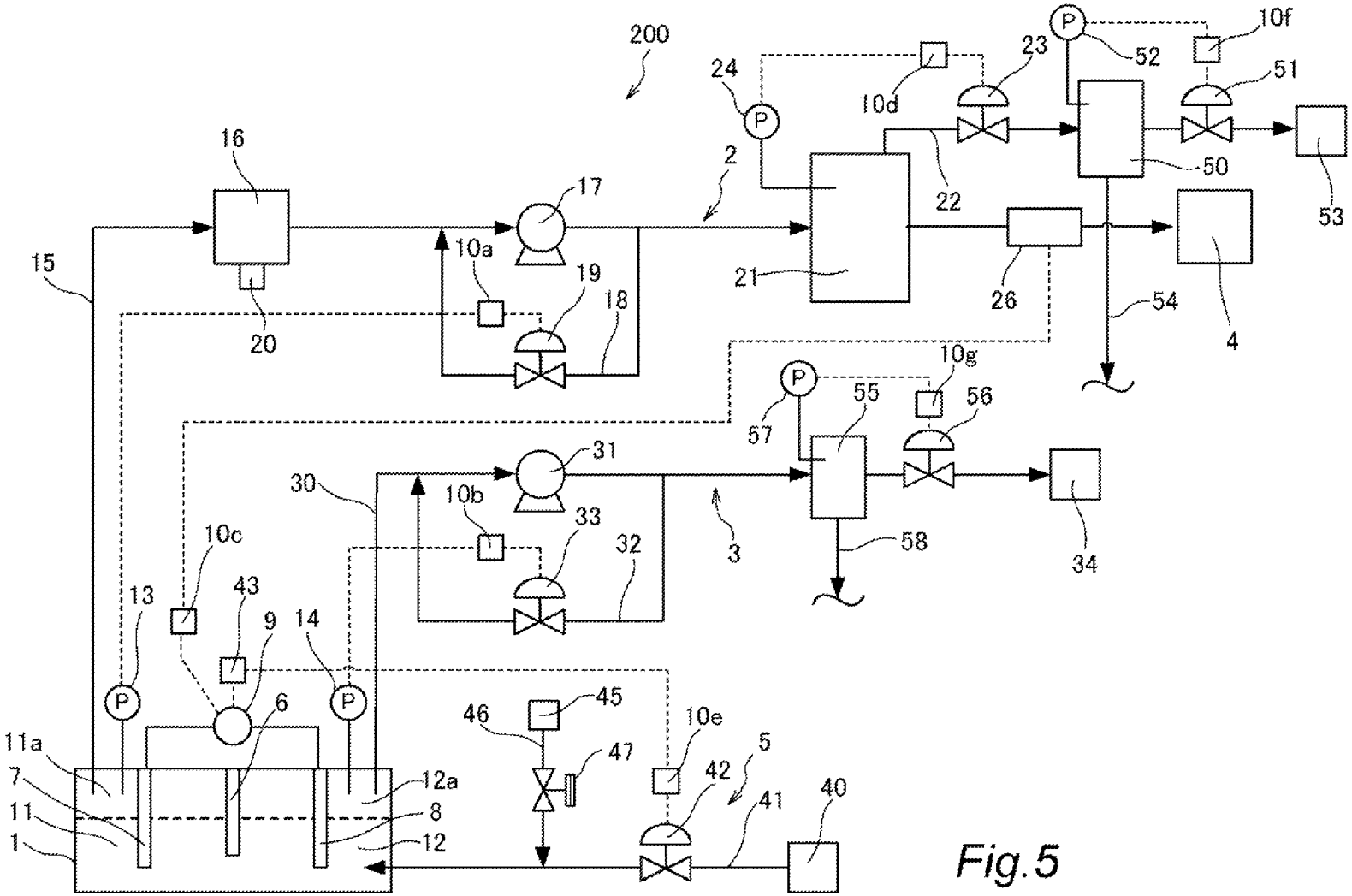
FIG. 5 is a system diagram illustrating a fluorine gas generating apparatus according to a second embodiment of the present invention.

As illustrated in FIG. 5, a buffer tank 55 in which a hydrogen gas generated at the cathode 8 of the electrolytic cell 1 and conveyed by the second pump 31 is retained is provided in the second main passage 30. A pressure regulating valve 56 which controls the internal pressure of the buffer tank 55 is provided on the downstream of the buffer tank 55. Moreover, a pressure meter 57 which detects the internal pressure is provided in the buffer tank 55. A detection result of the pressure meter 57 is outputted to a controller 10*g*. The controller 10*g* controls the opening degree of the pressure regulating valve 56 so that the internal pressure of the buffer tank 55 becomes a set value determined in advance. The set value is set to a pressure higher than the atmospheric pressure. The hydrogen gas discharged from the buffer tank 55 through the pressure regulating valve 56 is rendered harmless at the abatement unit 34 and emitted. As described above, the pressure regulating valve 56 executes control such that the internal pressure of the buffer tank 55 becomes the set value. A hydrogen gas supply passage 58 which supplies the hydrogen gas to the refining device 16 is connected to the buffer tank 55.

Moreover, in the fluorine gas generating apparatus 200, the configuration of the refining device 16 is partially different from that of the first embodiment. The apparatus will be described by referring to FIG. 6.

A lower end of the hydrogen gas supply passage 58 connected to the buffer tank 55 is connected to the upstream of the outlet valve 66*a* in the outlet passage 65*a*. A shut-off valve 59*a* which switches between supply and shut-off of the hydrogen gas to the inner tube 61*a* is provided in the hydrogen gas supply passage 58.

The internal pressure of the buffer tank 55 is controlled by the pressure regulating valve 56 to a pressure higher than the atmospheric pressure. Therefore, by opening the shut-off valve 59*a*, the hydrogen gas retained in the buffer tank 55 is supplied to the inner tube 61*a* by the differential pressure between the buffer tank 55 and the inner tube 61*a*.

As described above, in the fluorine gas generating apparatus 200, the hydrogen gas generated in the cathode chamber 12 of the electrolytic cell 1 and retained in the buffer tank 55 is used as a carrier gas used for discharge of dissolved hydrogen fluoride in the inner tube 61*a* and for conveying thereof to the electrolytic cell 1. Since the hydrogen gas is used as a carrier gas, the hydrogen fluoride conveyed through the merged conveying passage 95 is recovered into the cathode chamber 12 of the electrolytic cell 1.

A lower end of the fluorine gas supply passage 54 connected to the second buffer tank 50 (See FIG. 5) is connected to the downstream of the inlet valve 64*a* in the inlet passage 63*a*. The shut-off valve 88*a* which switches between supply and shut-off of the fluorine gas to the inner tube 61*a* is provided in the fluorine gas supply passage 54.

The internal pressure of the second buffer tank 50 is controlled by the pressure regulating valve 51 (See FIG. 5) to a pressure higher than the atmospheric pressure. Therefore, by opening the shut-off valve 88*a*, the fluorine gas retained in the second buffer tank 50 is supplied to the inner tube 61*a* by the differential pressure between the second buffer tank 50 and the inner tube 61*a*. The fluorine gas retained in the second buffer tank 50 is used as a fill gas when the refining device 16 is regenerated.

Figure 6:
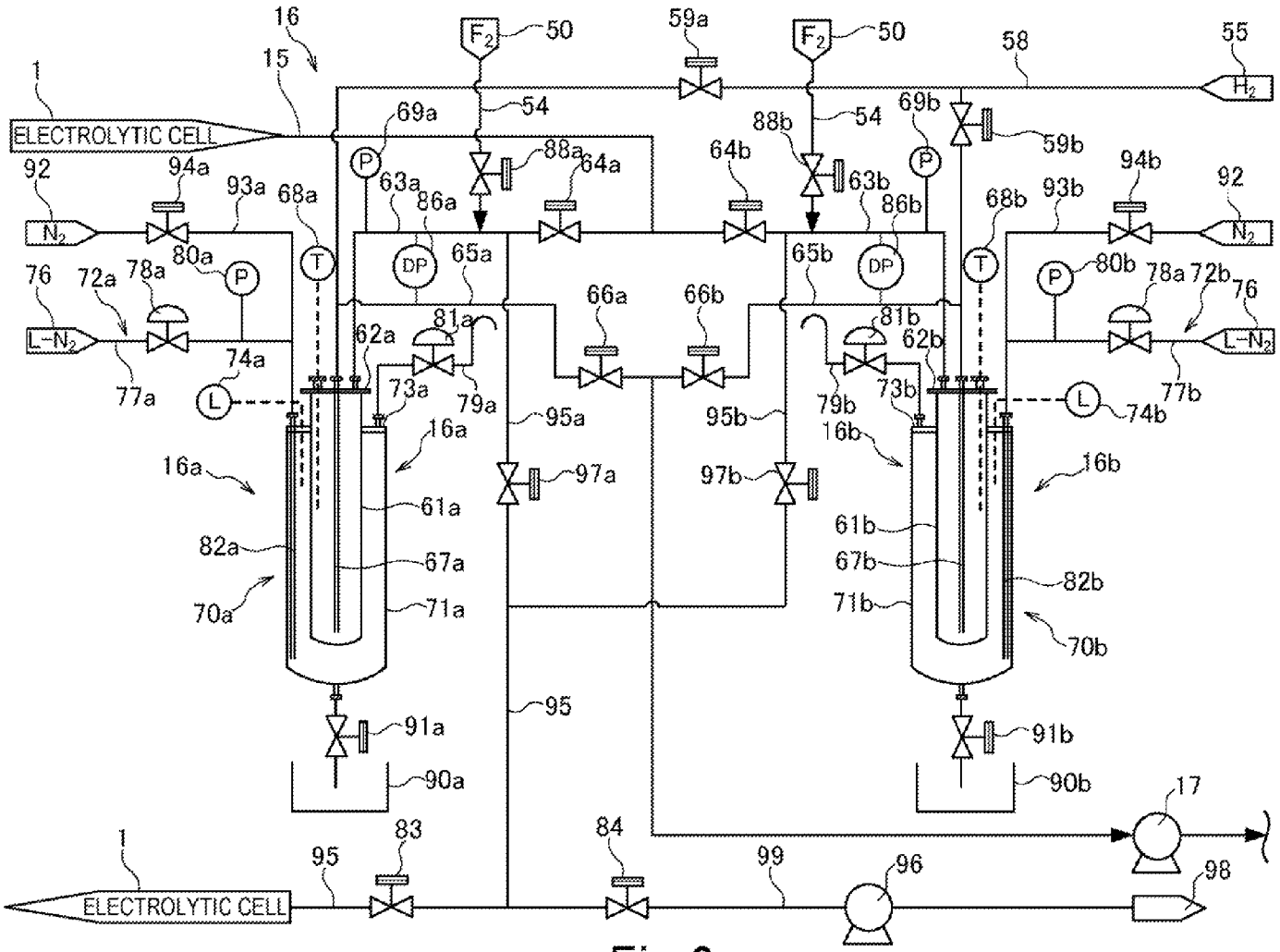
FIG. 6 is a system diagram of a refining device in the fluorine gas generating apparatus according to the second embodiment of the present invention.
Figure 7:
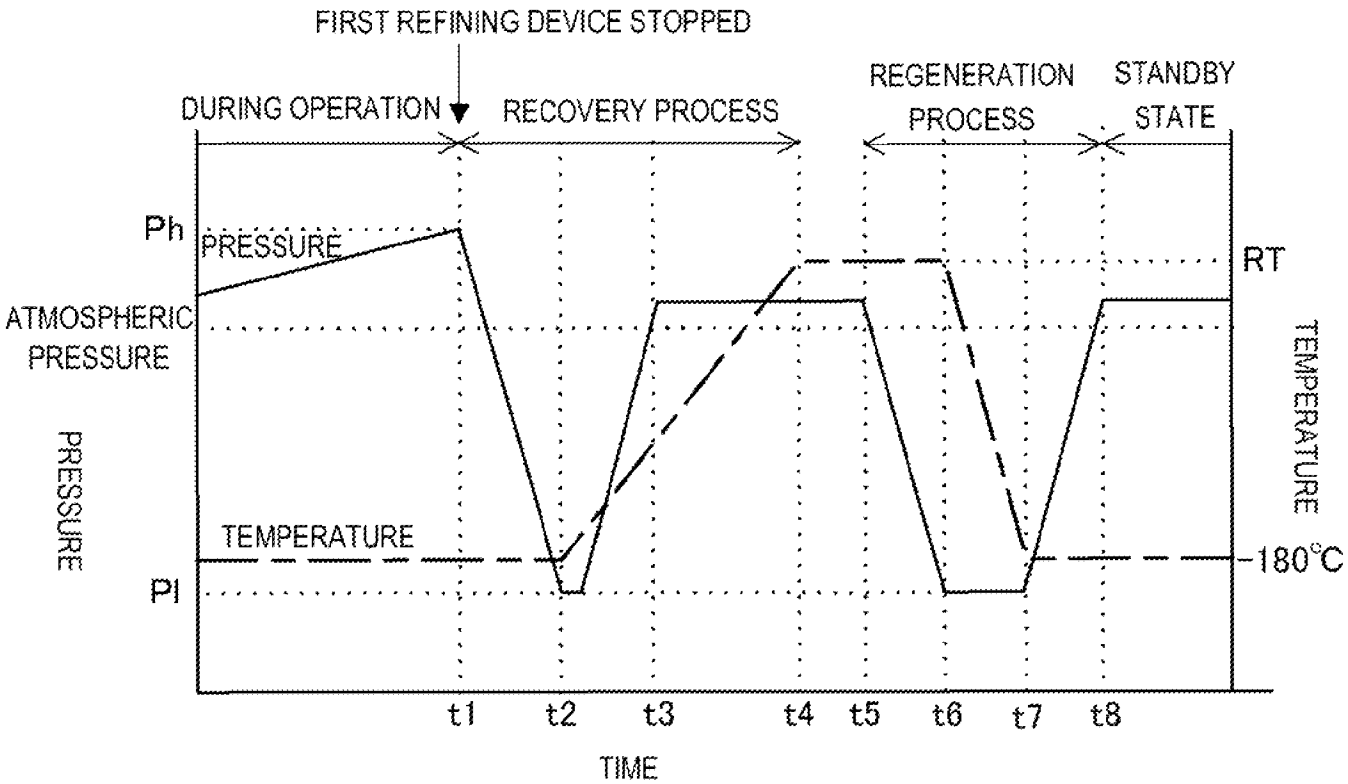
FIG. 7 is a graph illustrating temporal changes of a pressure and a temperature in an inner tube of the refining device, in which a solid line indicates the pressure and an alternate long and short dash line indicates the temperature.

Subsequently, an operation of the refining device 16 will be described by referring to FIGS. 6 and 7, but since only the recovery process and the regeneration process are different from the first embodiment, only the recovery process and the regeneration process will be described. FIG. 7 is a graph illustrating temporal changes of a pressure and a temperature in the inner tube 61*a* of the first refining device 16*a*, in which a solid line indicates the pressure and an alternate long and short dash line indicates the temperature. The pressure shown in FIG. 7 is detected by the pressure meter 69*a*, and the temperature is detected by the thermometer 68*a*.

If the accumulated amount of hydrogen fluoride coagulated in the inner tube 61*a* increases, the internal pressure of the inner tube 61*a* rises. When the differential pressure between the inlet and the outlet of the inner tube 61*a* reaches a predetermined value, the inlet valve 64*b* and the outlet valve 66*b* of the inner tube 61*b* of the second refining device 16*b* are opened, and then, the inlet valve 64*a* and the outlet valve 66*a* of the inner tube 61*a* of the first refining device 16*a* are closed so that the operation is switched from the first refining device 16*a* to the second refining device 16*b* (time t1).

In the stopped first refining device 16*a*, the recovery process of trapped hydrogen fluoride is executed in compliance with the following procedure:

First, the discharge valve 97*a* of the conveying passage 95*a* and the shut-off valve 84 of the branch passage 99 are opened, and the fluorine gas in the inner tube 61*a* is suctioned by the vacuum pump 96, rendered harmless in the abatement unit 98 and emitted. At the time when the internal pressure of the inner tube 61*a* lowers to the predetermined pressure P1 (not more than 10 Pa) not more than the atmospheric pressure (time t2), the shut-off valve 84 is closed, and deaeration in the inner tube 61*a* is completed. Since the hydrogen fluoride in the inner tube 61*a* is in the coagulated state, it is not suctioned by the vacuum pump 96. Moreover, in the above-described first embodiment, it was described that the inside of the inner tube 61*a* does not necessarily have to be deaerated. However, in the fluorine gas generating apparatus 200 using the hydrogen gas as a carrier gas, deaeration of the inside of the inner tube 61*a* is indispensable in order to prevent contact between the fluorine gas and the hydrogen gas in the inner tube 61*a*.

When the deaeration of the inside of the inner tube 61*a* is completed, the flow rate control valve 78*a* of the liquid nitrogen supply passage 77*a* is fully closed, supply of the liquid nitrogen to the jacket tube 71*a* is stopped, and then, the discharge valve 91*a* is fully opened to discharge the liquid nitrogen. After that, the shut-off valve 94*a* of the nitrogen gas supply passage 93*a* is opened, and the nitrogen gas at a normal temperature is supplied to the jacket tube 71*a*. As a result, as illustrated in FIG. 7, the temperature in the inner tube 61*a* rises, and the hydrogen fluoride in the inner tube 61*a* is dissolved.

Moreover, at the same time as the discharge of the liquid nitrogen in the jacket tube 71*a*, the shut-off valve 59*a* of the hydrogen gas supply passage 58 is opened, so that the hydrogen gas is supplied into the inner tube 61*a* as a carrier gas. As a result, the internal pressure of the inner tube 61*a* rises.

At the time when the internal pressure of the inner tube 61*a* reaches the atmospheric pressure which is the same pressure as in the electrolytic cell 1 (time t3), the shut-off valve 83 of the merged conveying passage 95 is opened, and the dissolved hydrogen fluoride in the inner tube 61*a* is accompanied by the hydrogen gas and conveyed to the cathode chamber 12 of the electrolytic cell 1. As a result, the dissolved hydrogen fluoride in the inner tube 61*a* is recovered in the electrolytic cell 1.

At the time when the temperature in the inner tube 61*a* reaches a normal temperature (RT) (time t4), the shut-off valve 83 and the shut-off valve 59*a* are closed, and the conveying of the hydrogen fluoride to the electrolytic cell 1 and the supply of the hydrogen gas as a carrier gas into the inner tube 61*a* are stopped. The recovery process of the trapped hydrogen fluoride is completed as above.

Subsequently, the regeneration process of the first refining device 16*a* is performed in compliance with the following procedure:

First, while the shut-off valve 84 of the branch passage 99 is fully opened (time t5), the hydrogen gas in the inner tube 61*a* is suctioned by the vacuum pump 96, rendered harmless in the abatement unit 98 and emitted. At the time when the internal pressure of the inner tube 61*a* lowers to the predetermined pressure P1 (not more than 10 Pa) not more than the atmospheric pressure (time t6), the shut-off valve 84 is closed, and deaeration of the inside of the inner tube 61*a* is completed.

Subsequently, while the discharge valve 91*a* and the shut-off valve 94*a* of the nitrogen gas supply passage 93*a* are fully closed, the flow rate control valve 78*a* of the liquid nitrogen supply passage 77*a* is opened, so that the liquid nitrogen is supplied into the jacket tube 71*a*. As a result, the internal temperature of the inner tube 61*a* lowers. The internal pressure of the jacket tube 71*a* is controlled by the pressure regulating valve 81*a* to 0.4 MPa, and thus, the internal temperature of the inner tube 61*a* is lowered to approximately −180° C. and is maintained at that temperature.

Subsequently, the shut-off valve 88*a* of the fluorine gas supply passage 54 is opened, and the fluorine gas is supplied into the inner tube 61*a* (time t7). As a result, the internal pressure of the inner tube 61*a* rises, and at the time when the internal pressure of the inner tube 61*a* becomes not less than the atmospheric pressure, the shut-off valve 88*a* is closed. The filling of the fluorine gas is completed as above (time t8).

Accordingly, the regeneration process of the first refining device 16*a* is completed. In the first refining device 16*a* during stop, the inner tube 61*a* is cooled to −180° C. and enters the standby state in which the fluorine gas is filled in the inner tube 61*a*. Therefore, when the differential pressure between the inlet and the outlet of the inner tube 61*b* in the second refining device 16*b* during operation reaches a predetermined value, the operation of the second refining device 16*b* is stopped, and the first refining device 16*a* is quickly started so that the operation of the refining device 16 can be switched.

As described above, in the fluorine gas generating apparatus 200, the hydrogen gas retained in the buffer tank 55 is used for the discharge of the dissolved hydrogen fluoride in the inner tube 61*a* and the conveying thereof to the electrolytic cell 1, and the fluorine gas retained in the second buffer tank 50 is used for the filling of the fluorine gas into the inner tube 61*a*.

According to the above-described embodiment, the following working effects are exerted.

The hydrogen gas generated in the electrolytic cell 1 is used as the carrier gas for conveying the hydrogen fluoride trapped in the refining device 16 to the electrolytic cell 1. Therefore, a dedicated carrier gas is no longer necessary, and a gas facility for that is not needed, either, so the fluorine gas generating apparatus 200 can be formed in a compact manner and a cost can be reduced.

Moreover, the hydrogen gas used as a carrier gas is the hydrogen gas generated at the cathode 8 of the electrolytic cell 1 and retained in the buffer tank 55 and is a byproduct gas which has conventionally been emitted to the outside. Since the hydrogen gas which has been emitted to the outside is used as a carrier gas in this way, the hydrogen gas can be effectively used, and also, the emission amount of the hydrogen gas to the outside and the hydrogen gas amount treated in the abatement unit 34 are reduced, thereby reducing a load to the abatement unit 34.

Another mode of the second embodiment will be described below.

In this second embodiment, the hydrogen gas is used as a carrier gas for conveying the hydrogen fluoride in the inner tubes 61*a* and 61*b* to the electrolytic cell 1.

Instead, an inactive gas such as a nitrogen gas, an argon gas and the like may be used as a carrier gas. In that case, in FIG. 6, the hydrogen gas supply passage 58 is replaced by an inactive gas supply passage 58 which supplies an inactive gas and also, a tank (not shown) which retains an inactive gas may be provided on an upstream end of the inactive gas supply passage 58. If an inactive gas is used as a carrier gas in this way, hydrogen fluoride accompanying and conveyed is recovered into the cathode chamber 12 of the electrolytic cell 1 similarly to the use of the hydrogen gas.

The procedures of the recovery process and the regeneration process when an inactive gas is used as a carrier gas are the same as the above-described procedure when the hydrogen gas is used.

If an inactive gas is used as a carrier gas, the buffer tank 55 which retains the hydrogen gas is no longer needed in the byproduct gas treatment system 3. Moreover, if a nitrogen gas is used as a carrier gas, the facility can be simplified by using the nitrogen gas in the nitrogen gas supply source 92 which is a supply source of the nitrogen gas led into the jacket tube 71*a*.

Third Embodiment

A fluorine gas generating apparatus 300 according to a third embodiment of the present invention will be described by referring to FIGS. 1 *and* 8.

Differences from the above-described first embodiment will be mainly described below and the same reference numerals are given to the same configuration as those in the first embodiment, and the description will be omitted.

Figure 8:
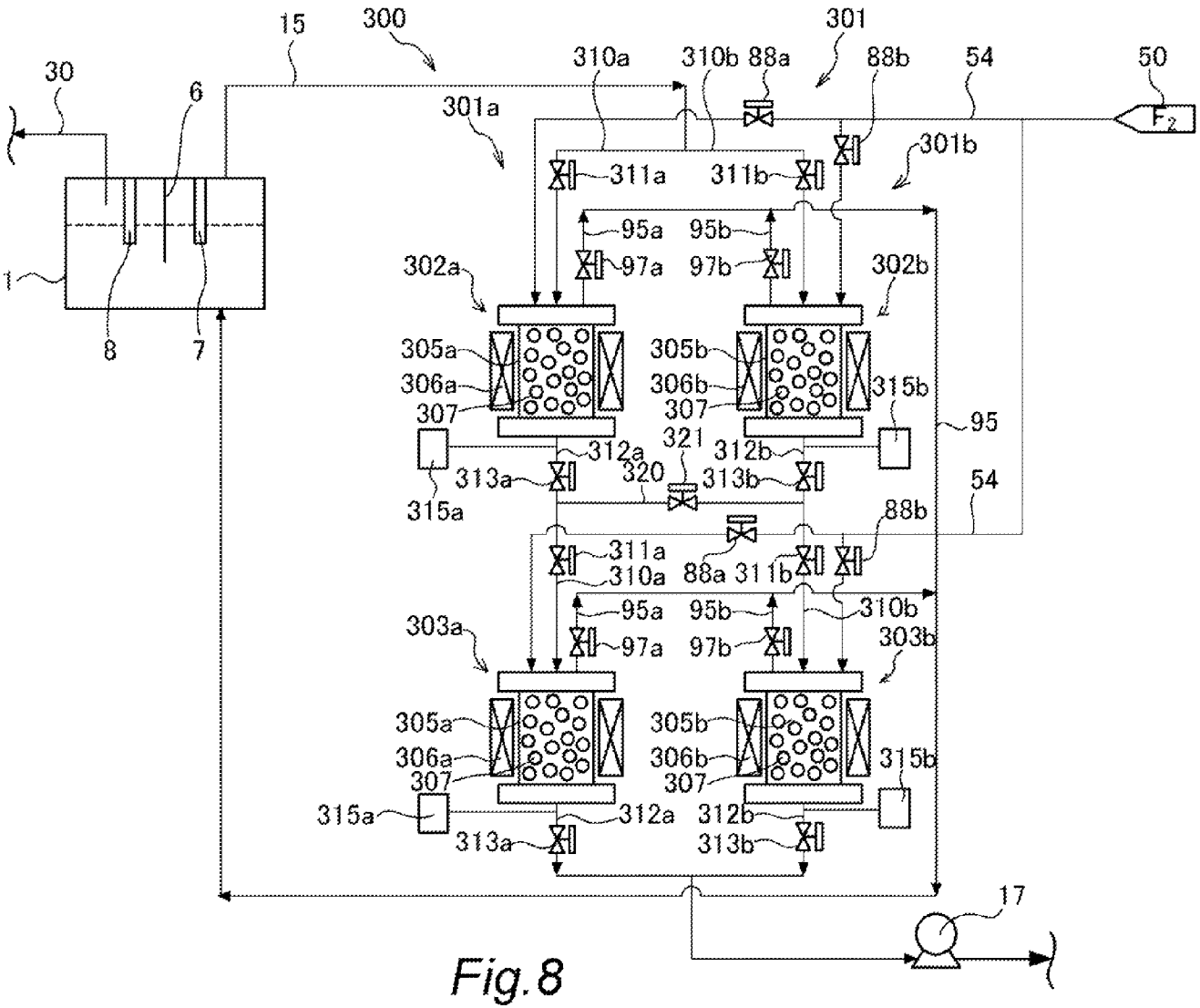
FIG. 8 is a system diagram illustrating a refining device in a fluorine gas generating apparatus according to a third embodiment of the present invention.

In a fluorine gas generating apparatus 300, only the configuration of the refining device which traps the hydrogen fluoride gas mixed in the fluorine gas and refines the fluorine gas is different from the first embodiment. A refining device 301 in the fluorine gas generating apparatus 300 will be described below by referring to FIG. 8.

The refining device 301 is a device which has the hydrogen fluoride gas in the fluorine gas adsorbed by an adsorbent so as to separate and to trap the hydrogen fluoride gas from the fluorine gas. The refining device 301 is composed of two systems, that is, a first refining device 301*a* and a second refining device 301*b* provided in parallel, and is switched so that the fluorine gas passes through only one of the systems. That is, when one of the first refining device 301*a* and the second refining device 301*b* is in the operating state, the other is stopped or in the standby state. In this embodiment, two units of the refining devices 301 are arranged in parallel, but three or more refining devices 301 may be arranged in parallel.

Since the first refining device 301*a* and the second refining device 301*b* have the same configuration, the first refining device 301*a* will be mainly described below, and the same reference numeral are given to the same configurations in the second refining device 301*b* as those in the first refining device 301*a*, and the description will be omitted. The configurations of the first refining device 301*a* are suffixed by "a" and the configurations of the second refining device 301*b* are suffixed by "b" for discrimination.

The first refining device 301*a* has an upstream refining tower 302*a* which roughly traps hydrogen fluoride mixed in the fluorine gas generated in the electrolytic cell 1 and a downstream refining tower 303*a* which removes hydrogen fluoride that cannot be fully recovered by the upstream refining tower 302*a* arranged in series.

First, the upstream refining tower 302*a* will be described.

The upstream refining tower 302*a* includes a cartridge 305*a* as a gas inflow unit into which the fluorine gas containing the hydrogen fluoride gas flows, an adsorbent 307 contained in the cartridge 305*a* and by which the hydrogen fluoride gas mixed in the fluorine gas is adsorbed, and a heater 306*a* as a temperature adjuster which adjusts the temperature of the cartridge 305*a*.

The cartridge 305*a* is a container which contains a large number of adsorbents 307, and a material of the cartridge preferably has resistance against fluorine gas and hydrogen fluoride gas such as metal including stainless steel, monel, nickel and the like, for example.

The adsorbent 307 is a porous bead made of sodium fluoride (NaF). Sodium fluoride has its adsorption capability changed depending on the temperature, and thus, the heater 306*a* is provided in the periphery of the cartridge 305*a*, and the temperature in the cartridge 305*a* is adjusted by the heater 306*a*. As a chemical used in the adsorbent 307, alkali metal fluorides such as KF, RbF, CsF and the like can be used other than sodium fluoride, but sodium fluoride is particularly preferable.

Any temperature adjuster can be used as long as it can adjust the temperature in the cartridge 305*a*, but a heating/cooling device using steam heating, a heating medium or a cooling medium, for example, may be used in addition to the heater 306*a*.

An inlet passage 310*a* which leads the fluorine gas generated at the anode 7 therein is connected to the cartridge 305*a*. The inlet passage 310*a* is one of two branches from the first main passage 15, and the other inlet passage 310*b* is connected to a cartridge 305*b* of the second refining device 301*b*. An inlet valve 311*a* which allows or shuts off inflow of the fluorine gas into the cartridge 305*a* is provided in the inlet passage 310*a*.

Moreover, an outlet passage 312*a* which discharges the fluorine gas is connected to the cartridge 305*a*. An outlet valve 313*a* which allows or shuts off outflow of the fluorine gas from the cartridge 305*a* is provided in the outlet passage 312*a*.

As described above, the fluorine gas generated at the anode 7 flows into the cartridge 305*a* through the inlet passage 310*a* and flows out of the cartridge 305*a* through the outlet passage 312*a*. When the first refining device 301*a* is in the operating state, the inlet valve 311*a* and the outlet valve 313*a* are in the open state, and the fluorine gas passes through the cartridge 305*a*, while when the first refining device 301*a* is stopped or in the standby state, the inlet valve 311*a* and the outlet valve 313*a* are in the closed state.

A concentration detector 315*a* which optically analyzes and detects hydrogen fluoride concentration in the fluorine gas passing through the cartridge 305*a* is provided on the upstream of the outlet valve 313*a* in the outlet passage 312*a*. Concentration detectors are not particularly limited as long as it can analyze the hydrogen fluoride concentration, but Fourier transform infrared spectrometer (FT-IR) can be cited, for example.

The upstream refining tower 302*a* also includes a recovery facility which conveys and recovers the hydrogen fluoride trapped in the cartridge 305*a* into the electrolytic cell 1 and a regeneration facility which regenerates the upstream refining tower 302*a*. The recovery facility and the regeneration facility will be described below.

A lower end of the fluorine gas supply passage 54 connected to the second buffer tank 50 (See FIG. 1) is connected to the cartridge 305*a*. The shut-off valve 88*a* which switches between supply and shut-off of the fluorine gas to the cartridge 305*a* is provided in the fluorine gas supply passage 54.

The internal pressure of the second buffer tank 50 is controlled by the pressure regulating valve 51 (See FIG. 1) to a pressure higher than the atmospheric pressure. Therefore, by opening the shut-off valve 88*a*, the fluorine gas retained in the second buffer tank 50 is supplied to the cartridge 305*a* by the differential pressure between the second buffer tank 50 and the cartridge 305*a*.

Moreover, the conveying passage 95*a* which discharges and conveys the hydrogen fluoride adsorbed by the adsorbent 307 in the cartridge 305*a* is connected to the cartridge 305*a*. The conveying passage 95*a* and the conveying passage 95*b* of the second refining device 301*b* are merged and becomes the merged conveying passage 95, and a lower end of the merged conveying passage 95 is connected to the electrolytic cell 1. The discharge valves 97*a* and 97*b* opened in discharge of the hydrogen fluoride are provided in the conveying passages 95*a* and 95*b*, respectively.

The hydrogen fluoride trapped by the adsorbent 307 in the cartridge 305*a* is conveyed through the conveying passage 95*a* and the merged conveying passage 95 and recovered in the electrolytic cell 1 by supplying the fluorine gas into the cartridge 305*a* through the fluorine gas supply passage 54. As described above, the hydrogen fluoride in the cartridge 305*a* is accompanied by the fluorine gas and recovered in the electrolytic cell 1 by supplying the fluorine gas as a carrier gas into the cartridge 305*a*. Since the fluorine gas is used as a carrier gas, the hydrogen fluoride conveyed through the merged conveying passage 95 is recovered in the anode chamber 11 of the electrolytic cell 1.

After the hydrogen fluoride in the cartridge 305*a* is discharged, it is necessary to fill the fluorine gas in the cartridge 305*a* and to regenerate the first refining device 301*a*. That is because while the second refining device 301*b* is operating, when the hydrogen fluoride concentration in the fluorine gas having passed through the cartridge 305*b* reaches the predetermined concentration, it can be quickly switched to the first refining device 301*a*.

Here, if the fluorine gas is used as a carrier gas, at the same time as the discharge of the hydrogen fluoride in the cartridge 305*a* is completed, the filling of the fluorine gas into the cartridge 305*a*, that is, the regeneration of the first refining device 301*a* is completed.

As described above, the fluorine gas retained in the second buffer tank 50 is used for the discharge of the hydrogen fluoride in the cartridge 305*a*, the conveying to the electrolytic cell 1, and the filling of the fluorine gas in the cartridge 305*a*.

Since the downstream refining tower 303*a* has the configuration similar to that of the upstream refining tower 302*a*, the same reference numerals are given to the similar configuration as in the upstream refining tower 302*a*, and the description will be omitted.

The outlet passage 312*a* connected to the cartridge 305*a* of the downstream refining tower 303*a* merges with an outlet passage 312*b* connected to the cartridge 305*b* of the downstream refining tower 303*b* and is connected to the first pump 17.

The upstream of the inlet valve 311*a* of the downstream refining tower 303*a* in the first refining device 301*a* and the upstream of an inlet valve 311*b* of the downstream refining tower 303*b* in the second refining device 301*b* communicate with each other through a bypass passage 320. A switching valve 321 which selectively leads the fluorine gas to the downstream refining tower 303*a* or the downstream refining tower 303*b* is provided in the bypass passage 320. Since the first refining device 301*a* and the second refining device 301*b* communicate with each other in the bypass passage 320 as above, the fluorine gas having passed through the upstream refining tower 302*a* or the upstream refining tower 302*b* can be selectively led to the downstream refining tower 303*a* or the downstream refining tower 303*b* by opening/closing the switching valve 321.

The temperatures of the cartridges 305*a* of the upstream refining tower 302*a* and the downstream refining tower 303*a* are controlled by the heaters 306*a*, respectively. Since sodium fluoride has high adsorption capability of hydrogen fluoride in a range of an approximately room temperature, its adsorption amount becomes large and it can easily deteriorate. Thus, the temperature of the cartridge 305*a* of the upstream refining tower 302*a* is preferably set to a temperature such that most of the hydrogen fluoride is adsorbed by the adsorbent 307, while a large load is not applied to the adsorbent 307. As described above, the upstream refining tower 302*a* functions as a rough trapping process which removes most of the hydrogen fluoride in the fluorine gas.

The temperature of the cartridge 305*a* of the upstream refining tower 302*a* is preferably adjusted in a range of 70 to 120° C., considering the required concentration of the, hydrogen fluoride in the fluorine gas and a load of the adsorbent 307. Moreover, it is particularly preferable to be adjusted in a range of 70 to 100° C. so that deterioration of sodium fluoride filled in the cartridge 305*a* is reduced, and the concentration of the hydrogen fluoride in the fluorine gas at the outlet of the upstream refining tower 302*a* becomes less than 1000 ppm.

Most of the hydrogen fluoride in the fluorine gas passing through the upstream refining tower 302*a* has been removed. Thus, the temperature of the cartridge 305*a* of the downstream refining tower 303*a* is preferably set approximately to a room temperature at which the adsorption capability of sodium fluoride increases so that the hydrogen fluoride that could not be fully removed in the upstream refining tower 302*a* is adsorbed by the adsorbent 307. As described above, the downstream refining tower 303*a* functions as a finishing trapping process which removes the hydrogen fluoride that could not be fully removed in the upstream refining tower 302*a*.

The temperature of the cartridge 305*a* of the downstream refining tower 303*a* is preferably adjusted to a range of 0 to 50° C. so that the concentration of the hydrogen fluoride in the fluorine gas at the outlet of the downstream refining tower 303*a* becomes less than 100 ppm.

As described above, by setting the temperature of the cartridge 305*a* of the upstream refining tower 302*a* higher than the temperature of the cartridge 305*a* of the downstream refining tower 303*a*, the hydrogen fluoride can be trapped in two stages, that is, rough trapping in the upstream refining tower 302*a* and finishing trapping in the downstream refining tower 303*a*, and thus, deterioration of the adsorbents 307 in the upstream refining tower 302*a* and the downstream refining tower 303*a* can be prevented.

Subsequently, an operation of the refining device 301 configured as above will be described. The operation of the refining device 301 illustrated below is controlled by the controller 20 (See FIG. 1) as a controller mounted on the fluorine gas generating apparatus 300. The controller 20 controls the operation of each valve and each pump on the basis of detection results of the concentration detectors 315*a*, 315*b* and the like.

The case in which the first refining device 301*a* is in the operating state and the second refining device 301*b* is in the standby state will be described. In the first refining device 301*a*, the inlet valve 311*a* and the outlet valve 313*a* of the upstream refining tower 302*a* are in the open state, and the inlet valve 311*a* and the outlet valve 313*a* of the downstream refining tower 303*a* are also in the open state, and the fluorine gas is continuously led out of the electrolytic cell 1 into the cartridges 305*a* of the upstream refining tower 302*a* and the downstream refining tower 303*a*, respectively. On the other hand, in the second refining device 301*b*, the inlet valve 311*b* and the outlet valve 313*b* of the upstream refining tower 302*b* are in the closed state, and the inlet valve 311*b* and the outlet valve 313*b* of the downstream refining tower 303*b* are also in the closed state, and the upstream refining tower 302*b* and the downstream refining tower 303*b* are in the standby state in which the fluorine gas is filled in the respective cartridges 305*b*. In this way, the fluorine gas generated in the electrolytic cell 1 passes only through the first refining device 301*a*.

The first refining device 301*a* in the operating state will be described below.

The fluorine gas generated in the electrolytic cell 1 passes through the cartridge 305*a* of the upstream refining tower 302*a* and then, passes through the cartridge 305*a* of the downstream refining tower 303*a*. In this process, the hydrogen fluoride in the fluorine gas is adsorbed by the adsorbent 307 in the upstream refining tower 302*a* and roughly trapped and then, adsorbed by the adsorbent 307 in the downstream refining tower 303*a* and finishingly trapped.

When the adsorption amount of the hydrogen fluoride adsorbed by the adsorbent 307 in the cartridge 305*a* of the upstream refining tower 302*a* increases and the concentration of the hydrogen fluoride detected by the concentration detector 315*a* provided in the outlet passage 312*a* reaches a predetermined value, the operation of the upstream refining tower 302*a* is stopped, and the upstream refining tower 302*b* in the standby state is started so that the operation of the upstream refining tower 302 is switched. Specifically, the inlet valve 311*b* and the outlet valve 313*b* of the upstream refining tower 302*b* are opened and the switching valve 321 is opened, and then, the inlet valve 311*a* and the outlet valve 313*a* of the upstream refining tower 302*a* are closed. As a result, the upstream refining tower 302*b* is started, while the upstream refining tower 302*a* is stopped, and the fluorine gas from the electrolytic cell 1 is led to the upstream refining tower 302*b* and led to the downstream refining tower 303*a* through the bypass passage 320.

Moreover, when the adsorption amount of the hydrogen fluoride adsorbed by the adsorbent 307 in the cartridge 305*a* increases and the concentration of the hydrogen fluoride detected by the concentration detector 315*a* provided in the outlet passage 312*a* reaches the predetermined value also in the downstream refining tower 303*a*, the operation of the downstream refining tower 303*a* is stopped, and the downstream refining tower 303*b* in the standby state is started so that the operation of the downstream refining tower 303 is switched. Specifically, the inlet valve 311*b* and the outlet valve 313*b* of the downstream refining tower 303*b* are opened and then, the inlet valve 311*a* and the outlet valve 313*a* of the downstream refining tower 303*a* are closed, and the switching valve 321 is closed. As a result, the downstream refining tower 303*b* is started, and the downstream refining tower 303*a* is stopped so that the fluorine gas from the electrolytic cell 1 is led from the upstream refining tower 302*b* to the downstream refining tower 303*b*.

In the stopped upstream refining tower 302*a* and downstream refining tower 303*a*, the recovery process and the regeneration process of the trapped hydrogen fluoride are performed in compliance with the following procedure. Since the procedures of the recovery process and the regeneration process of the upstream refining tower 302*a* and the downstream refining tower 303*a* are the same, only the upstream refining tower 302*a* will be described.

First, the shut-off valve 88*a* of the fluorine gas supply passage 54 is opened, the fluorine gas is supplied into the cartridge 305*a* as a carrier gas, and the discharge valve 97*a* of the conveying passage 95*a* is opened. As a result, the hydrogen fluoride adsorbed by the adsorbent 307 in the cartridge 305*a* and trapped is accompanied by the fluorine gas and conveyed to the anode chamber 11 of the electrolytic cell 1.

When the trapped hydrogen fluoride is conveyed to the electrolytic cell 1, the temperature of the cartridge 305*a* is adjusted by the heater 306*a* to a range of 150 to 300° C. As a result, the hydrogen fluoride adsorbed by the adsorbent 307 in the cartridge 305*a* is removed and can be easily accompanied by the fluorine gas and conveyed to the electrolytic cell 1.

By maintaining this state for a predetermined time, all the hydrogen fluoride in the cartridge 305*a* is recovered in the electrolytic cell 1, the shut-off valve 88*a* and the discharge valve 97*a* are closed, and the recovery process of the trapped hydrogen fluoride is completed.

Subsequently, in order to bring the upstream refining tower 302*a* into the standby state, the temperature setting of the cartridge 305*a* is changed from 150 to 300° C. to the normal temperature of 70 to 120° C. Here, since the cartridge 305*a* is already filled with the fluorine gas supplied as a carrier gas, the regeneration process is also completed by the change of the set temperature of the cartridge 305*a*, and the upstream refining tower 302*a* enters the standby state.

As described above, since the stopped upstream refining tower 302*a* is brought into the standby state, when the concentration of the hydrogen fluoride at the outlet of the operating upstream refining tower 302*b* reaches the predetermined value, the operation of the upstream refining tower 302*b* is stopped, and the upstream refining tower 302*a* is quickly started so that the operation of the upstream refining tower 302 is switched.

A controller may be provided in the concentration detectors 315*a* and 315*b* so that the operation of the refining device 301 is controlled by the controller.

According to the above-described embodiment, the following working effects are exerted.

Since the hydrogen fluoride trapped in the refining device 301 is recovered in the electrolytic cell 1 and reused in order to generate the fluorine gas, hydrogen fluoride which is a component other than the fluorine gas trapped in the process of refining the fluorine gas can be effectively used.

Moreover, the fluorine gas generated in the electrolytic cell 1 is used as a carrier gas which conveys the hydrogen fluoride trapped in the refining device 301 to the electrolytic cell 1. Therefore, a dedicated carrier gas is no longer necessary, and a gas facility for that is not needed, either, and the fluorine gas generating apparatus 300 can be formed in a compact manner and a cost can be reduced.

Moreover, the refining device 301 is composed of at least two systems, and it can be operated at any time since the refining device 301 of the system stopped by the operation switching is regenerated and enters the standby state after the hydrogen fluoride is discharged from the cartridges 305*a* and 305*b*. Thus, when the adsorption amount of hydrogen fluoride adsorbed by the adsorbents 307 in the cartridges 305*a* and 305*b* of the refining device 301 of the operating system becomes large, the refining device 301 of the standby system can be quickly started. Therefore, it is not necessary to stop the fluorine gas generating apparatus 300, and the fluorine gas can be stably supplied to the external device 4.

Another mode of the third embodiment will be described below.

(1) In the above-described third embodiment, the mode in which the fluorine gas is used as a carrier gas in the recovery facility which conveys and recovers the hydrogen fluoride trapped in the cartridges 305*a* and 305*b* into the electrolytic cell 1 has been described.

Figure 9:
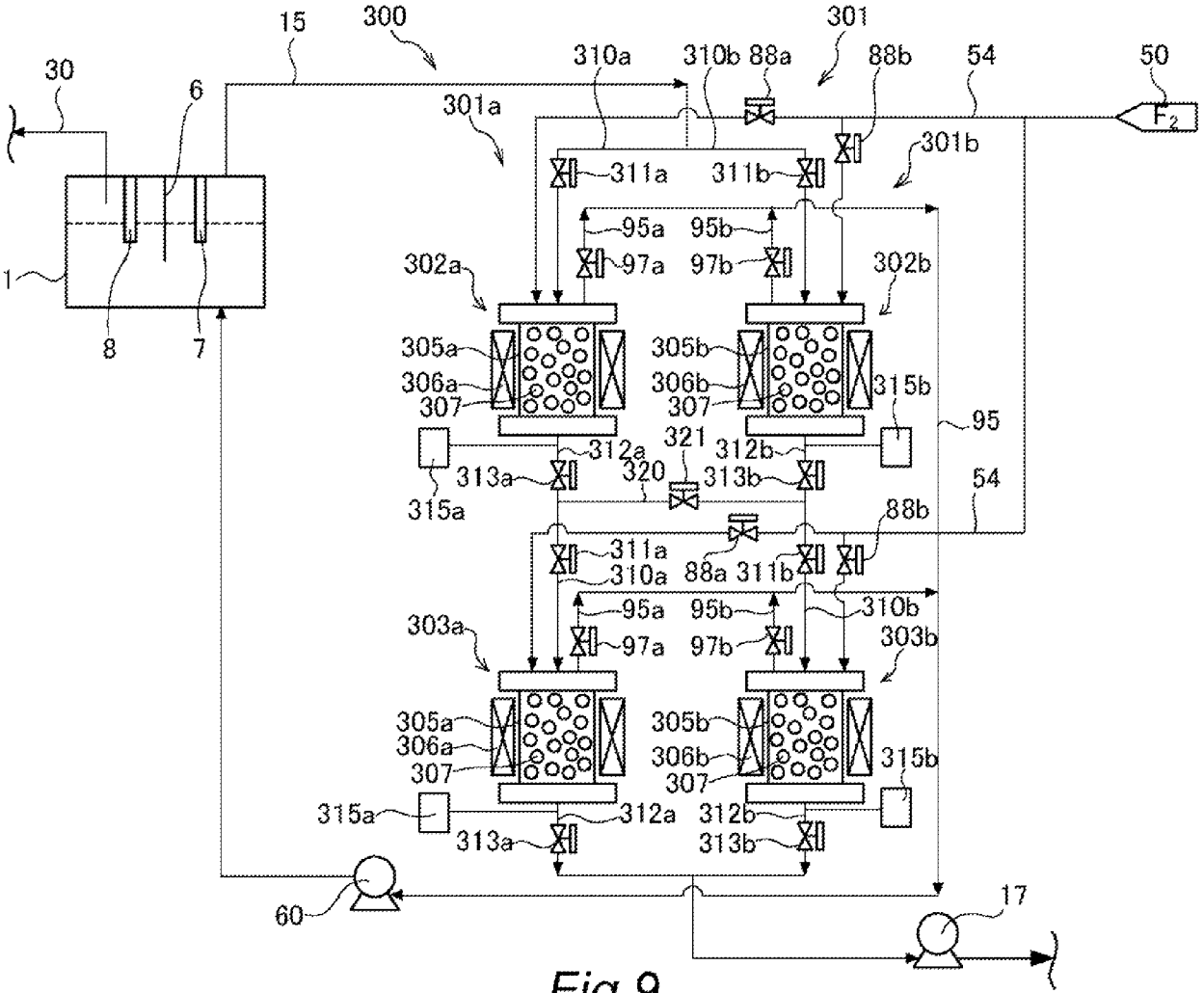
FIG. 9 is a system diagram of another embodiment of the fluorine gas generating apparatus according to the third embodiment of the present invention.

As another configuration of the recovery facility, as illustrated in FIG. 9, it may be so configured that a conveying pump 60 as a suction device is provided in the merged conveying passage 95 so as to suction the insides of the cartridges 305*a* and 305*b* by the conveying pump 60 without using a carrier gas and to convey and recover the hydrogen fluoride into the anode chamber 11 of the electrolytic cell 1.

As a procedure of the recovery process, the conveying pump 60 is driven and the discharge valve 97*a* is opened instead of supplying the fluorine gas as a carrier gas in the cartridge 305*a*, whereby the hydrogen fluoride in the cartridge 305*a* is conveyed to the electrolytic cell 1, and this point is different from the procedure illustrated in the above-described third embodiment. That is, the trapped hydrogen fluoride is conveyed to the electrolytic cell 1 by suctioning the insides of the cartridges 305*a* and 305*b* by the conveying pump 60.

In the case of this configuration, the supply of the fluorine gas through the fluorine gas supply passage 54 is performed only when the fluorine gas is filled in the cartridges 305*a* and 305*b* in the regeneration process.

Figure 10:
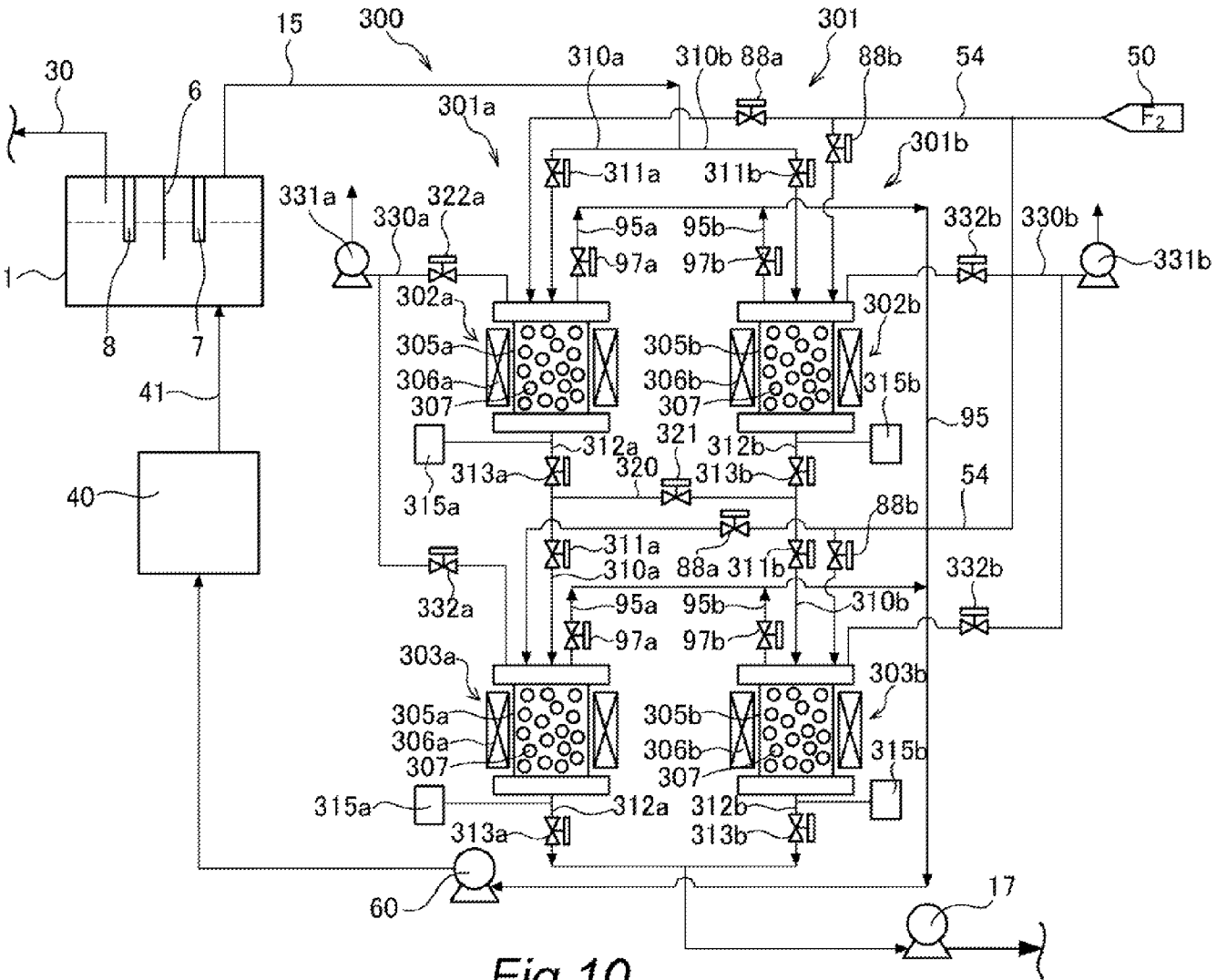
FIG. 10 is a system diagram of another embodiment of the fluorine gas generating apparatus according to the third embodiment of the present invention.

(2) If the hydrogen fluoride is recovered by using the conveying pump 60 without using a carrier gas, by deaerating the fluorine gas in the cartridges 305*a* and 305*b* before the conveying of the hydrogen fluoride by the conveying pump 60, only the hydrogen fluoride is recovered. Therefore, as illustrated in FIG. 10, the hydrogen fluoride may be recovered in the hydrogen fluoride supply source 40 instead of the electrolytic cell 1. That is, the hydrogen fluoride trapped in the cartridges 305*a* and 305*b* may be conveyed and recovered in the hydrogen fluoride supply source 40.

As the facility which deaerates the fluorine gas in the cartridges 305*a* and 305*b*, as illustrated in FIG. 10, it may be so configured that discharge passages 330*a* and 330*b* for deaeration of the insides are connected to the cartridges 305*a* and 305*b*, and vacuum pumps 331*a* and 331*b* and shut-off valves 332*a* and 332*b* are provided in the discharge passages 330*a* and 330*b*, and deaeration is performed by the vacuum pump 331.

The embodiments of the present invention have been described but the above-described embodiments illustrate only a part of application examples of the present invention and are not intended to limit the technical scope of the present invention to the specific configurations of the above-described embodiments.

This application claims priority on the basis of Japanese Patent Application No. 2009-274676 filed with Japan Patent Office on Dec. 2, 2009 and all the contents of this application is incorporated in this description by reference.

What is claimed is:

1. A fluorine gas generating apparatus which generates a fluorine gas by electrolyzing hydrogen fluoride in molten salt, comprising:

an electrolytic cell including, above a liquid level of molten salt, a first gas chamber into which a product gas mainly containing the fluorine gas generated at an anode immersed in the molten salt and a second gas chamber which is separated from the first gas chamber and into which a byproduct gas mainly containing a hydrogen gas generated at a cathode immersed in the molten salt;

a hydrogen fluoride supply source which retains hydrogen fluoride to be replenished in the electrolytic cell;

a refining device which traps a hydrogen fluoride gas evaporated from the molten salt in the electrolytic cell and mixed in the product gas generated from the anode to refine the fluorine gas; and a recovery facility which conveys the trapped hydrogen fluoride to the anode side of the electrolytic cell using the product gas as a carrier gas and recovers the hydrogen fluoride trapped in the refining device in the electrolytic cell.

2. The fluorine gas generating apparatus according to claim 1, wherein the refining device includes:

a gas inflow unit into which the product gas flows; and a cooling device which cools the gas inflow unit at a temperature equal to or higher than a boiling point of fluorine and equal to or lower than a melting point of hydrogen fluoride so that the hydrogen fluoride gas mixed in the product gas is coagulated and the fluorine gas passes through the gas inflow unit;

wherein the hydrogen fluoride gas is coagulated and trapped in the gas inflow unit; and wherein the recovery facility cancels cooling of the gas inflow unit by the cooling device and supplies the product gas as a carrier gas into the gas inflow unit to convey the trapped hydrogen fluoride to the electrolytic cell.

3. The fluorine gas generating apparatus according to claim 2, further comprising:

a controller which controls an operation of the refining device, wherein the refining devices are arranged at least in two units in parallel;

wherein each of the refining devices includes an accumulated state detector which detects an accumulated state of hydrogen fluoride of the gas inflow unit;

wherein the controller performs operation switching of the refining devices based on a detection result of the accumulated state detector so that the product gas is led to the refining device in a standby state; and wherein the controller performs discharge of the hydrogen fluoride from the gas inflow unit of the refining device stopped by the operation switching through the recovery facility and bringing the stopped refining device into the standby state by filling the product gas in the gas inflow unit.

4. The fluorine gas generating apparatus according to claim 1, further comprising:

a buffer tank which retains the product gas generated at the anode in the electrolytic cell; and the product gas used as the carrier gas is the product gas retained in the buffer tank.

5. The fluorine gas generating apparatus according to claim 1, wherein the refining device includes:

a gas inflow unit into which the product gas flows; and an adsorbent contained in the gas inflow unit and by which the hydrogen fluoride gas mixed in the product gas is adsorbed, wherein the hydrogen fluoride gas is adsorbed by the adsorbent and trapped; and wherein the recovery facility supplies the product gas as a carrier gas to the gas inflow unit to convey the hydrogen fluoride adsorbed by the adsorbent and trapped to the anode side of the electrolytic cell.

6. The fluorine gas generating apparatus according to claim 5, further comprising:

a buffer tank which retains the product gas generated at the anode in the electrolytic cell, wherein the product gas used as the carrier gas is the product gas retained in the buffer tank.

7. The fluorine gas generating apparatus according to claim 5, wherein the adsorbent is made of sodium fluoride;

the refining device further includes a temperature adjuster which adjusts a temperature of the gas inflow unit; and the temperature of the gas inflow unit is adjusted to a range of 150 to 300° C. in conveying the trapped hydrogen fluoride to the electrolytic cell.

8. The fluorine gas generating apparatus according to claim 5, further comprising:

a controller which controls an operation of the refining device, wherein the refining devices are arranged at least in two units in parallel;

wherein each of the refining devices includes a concentration detector which detects concentration of hydrogen fluoride in the product gas having passed through the gas inflow unit;

wherein the controller performs operation switching of the refining devices on the basis of a detection result of the concentration detector so that the fluorine gas is led to the refining device in a standby state; and wherein the controller performs discharge of the hydrogen fluoride from the gas inflow unit of the refining device stopped by the operation switching through the recovery facility and bringing the stopped refining device into the standby state by filling the product gas in the gas inflow unit.

9. A fluorine gas generating apparatus which generates a fluorine gas by electrolyzing hydrogen fluoride in molten salt, comprising:

an electrolytic cell including, above a liquid level of molten salt, a first gas chamber into which a product gas mainly containing the fluorine gas generated at an anode immersed in the molten salt and a second gas chamber which is separated from the first gas chamber and into which a byproduct gas mainly containing a hydrogen gas generated at a cathode immersed in the molten salt;

a hydrogen fluoride supply source which retains hydrogen fluoride to be replenished in the electrolytic cell;

a refining device which traps a hydrogen fluoride gas evaporated from the molten salt in the electrolytic cell and mixed in the product gas generated from the anode to refine the fluorine gas; and a recovery facility which conveys the trapped hydrogen fluoride to the cathode side of the electrolytic cell using the byproduct gas as a carrier gas and recovers the hydrogen fluoride trapped in the refining device in the electrolytic cell.

10. The fluorine gas generating apparatus according to claim 9, further comprising:

a buffer tank which retains the byproduct gas generated at the cathode in the electrolytic cell, wherein the byproduct gas used as the carrier gas is the byproduct gas retained in the buffer tank.

* * * * *